US005634793A

United States Patent [19]

Hasse

[11] Patent Number: 5,634,793

[45] Date of Patent: Jun. 3, 1997

[54] SIMULATION OF OPERATION FOR FAULT ISOLATION AND TRAINING

[75] Inventor: Paul L. Hasse, St. Paul, Minn.

[73] Assignee: FMC Corporation, Chicago, Ill.

[21] Appl. No.: 427,528

[22] Filed: Apr. 24, 1995

Related U.S. Application Data

[62] Division of Ser. No. 903,688, Jun. 24, 1992, Pat. No. 5,441,411.

[51] Int. Cl.[6] ..... F41G 7/30

[52] U.S. Cl. ..... 434/34; 434/24

[58] Field of Search ..... 434/34, 258, 335, 434/373

[56] References Cited

U.S. PATENT DOCUMENTS 3,992,786 11/1976 Greenberg et al. ..... 434/258
4,028,819 6/1977 Walker ..... 434/258
4,176,468 12/1979 Marty, Jr. .
4,193,210 3/1980 Turnquist ..... 434/335
4,286,289 8/1981 Ottesen et al. .
4,439,156 3/1984 Marshall et al. .
4,442,491 4/1984 Olhausen, Jr. .
4,635,030 1/1987 Rauch .
4,860,968 8/1989 Pinson .
5,042,743 8/1991 Carney .
5,366,376 11/1994 Cooperman et al. ..... 434/373 X

FOREIGN PATENT DOCUMENTS

WO83/01832 2/1983 WIPO .

*Primary Examiner*—Jerome Donnelly
*Assistant Examiner*—Glenn E. Richman
*Attorney, Agent, or Firm*—Michael B. K. Lee; Douglas W. Rudy

[57] ABSTRACT

The invention provides a method and apparatus for simulating a system, which provides a recording of steps taken in operation of the system. The invention provides teaching and evaluation for the use and repair of the system.

3 Claims, 13 Drawing Sheets

SIMULATION OF OPERATION FOR FAULT ISOLATION AND TRAINING

This is a division of application Ser. No. 903,688, filed Jun. 24, 1992 now, U.S. Pat. No. 5,441,411.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

In the prior art to simulate a launch system, actual launch system hardware with was used for training. Training was limited by the availability of such hardware and verification that the student checked certain indicators was not available.

The invention provides a method of simulating a system such as a launcher that uses readily available hardware and can among other functions provide a log which verifies the inspection of desired indicators.

FIG. 6 is an illustration of a screen display when the preferred embodiment is executing a launch control unit.

FIG. 1 is a schematic diagram of different units used in a preferred embodiment of the invention used to simulate a vertical launch control system for vertically launched missiles.

The preferred embodiment is a program called VSOFT™, which is copyrighted by FMC Corporation and was developed on a Macintosh II Computer using the program PLUS™ for implementation on a 486-based PC or a Macintosh II™, with a monitor and a central processing unit. PLUS™ is sold by Spinnaker Software Corporation. In the preferred embodiment a mouse and keyboard are used, but other input means such as a track ball may be used.

Figure 1:
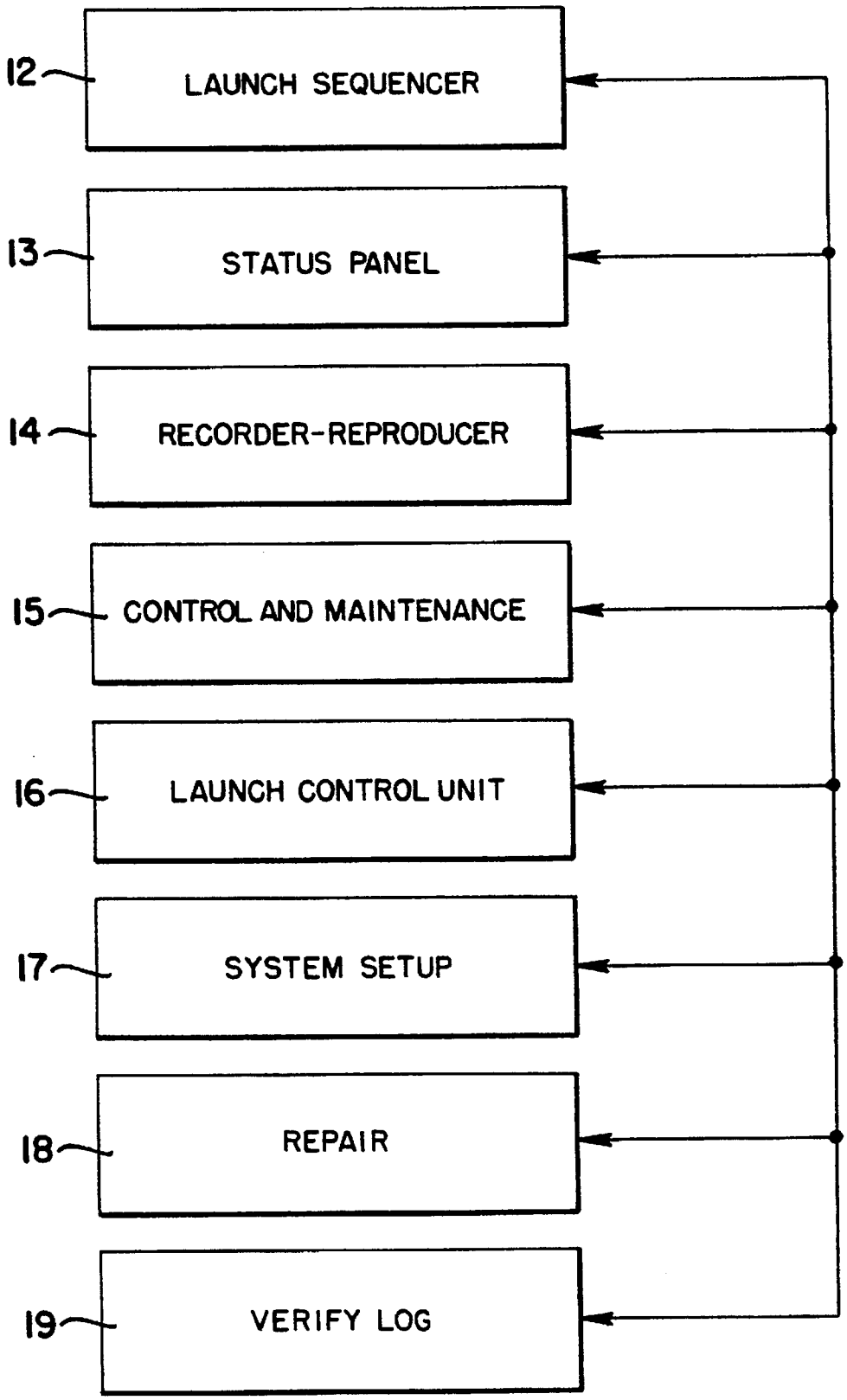
FIG. 1 is a schematic diagram of different units used in a preferred embodiment of the invention.

In FIG. 1, eight units which make up the program VSOFT are illustrated. The first unit is a launch sequencer unit 12. The second unit is a status panel unit 13. The third unit is a recorder-reproducer unit 14. The fourth unit is a control and maintenance unit 15. The fifth unit is a launch control unit 16. The sixth unit is a system setup unit 17. The seventh unit is a repair unit 18. The eighth unit is a verify log unit 19.

Figure 2:
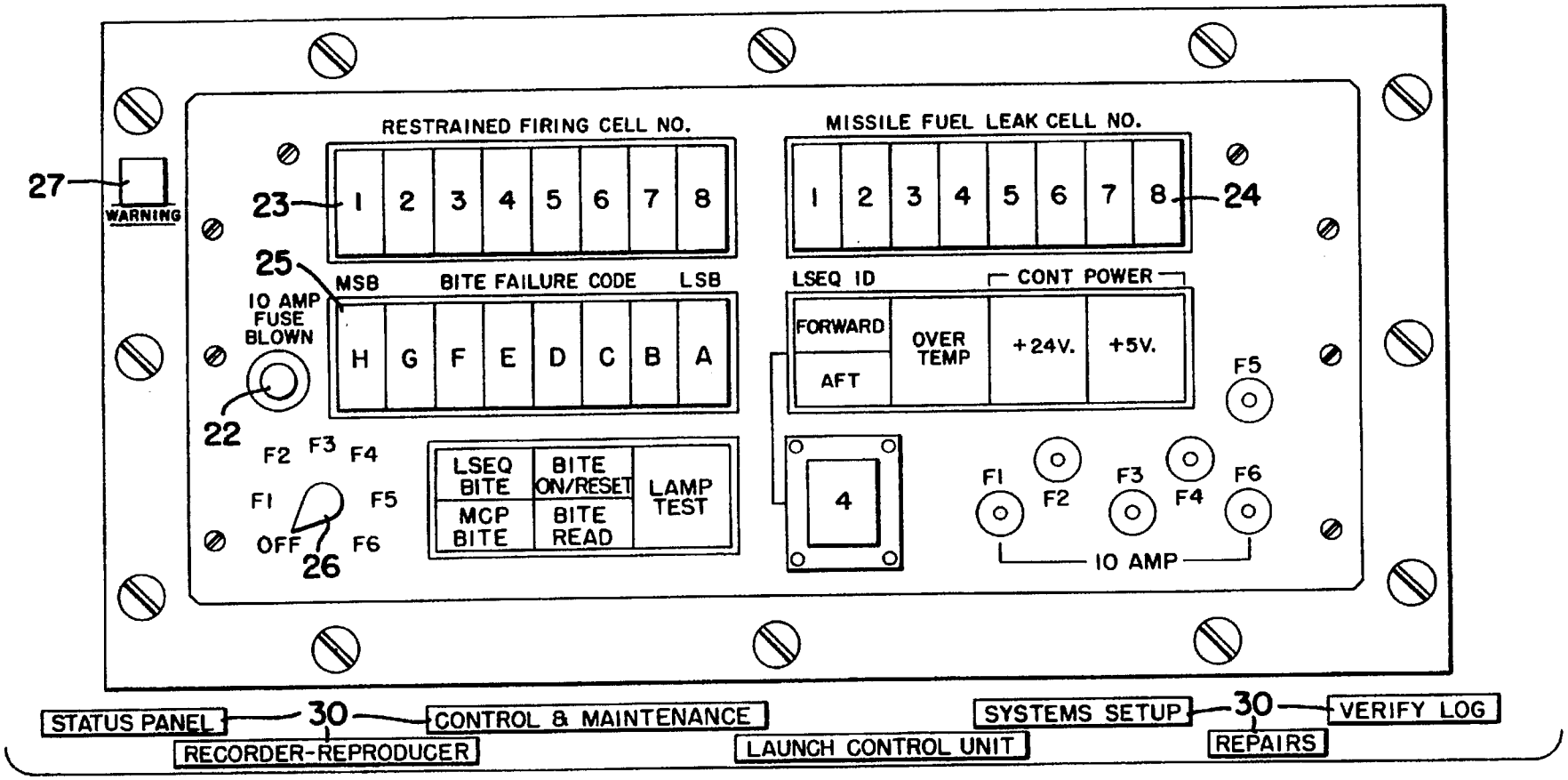
FIG. 2 is an illustration of a screen display when the preferred embodiment is executing a launch sequencer unit.

FIG. 2 is an illustration of a screen display when the preferred embodiment is executing the launch sequencer unit 12. In the preferred embodiment, the launch sequencer unit 12 displays a launch sequencer panel used in a vertical launch missile system. The display illustrates a blown fuse indicator 22, a restrained firing cell number indicator 23, a missile fuel leak cell number indicator 24, a bite failure code indicator 25, and a control switch 26. At the bottom of the display are buttons 30 for going to the other units. The display also provides a warning button 27.

Figure 3:
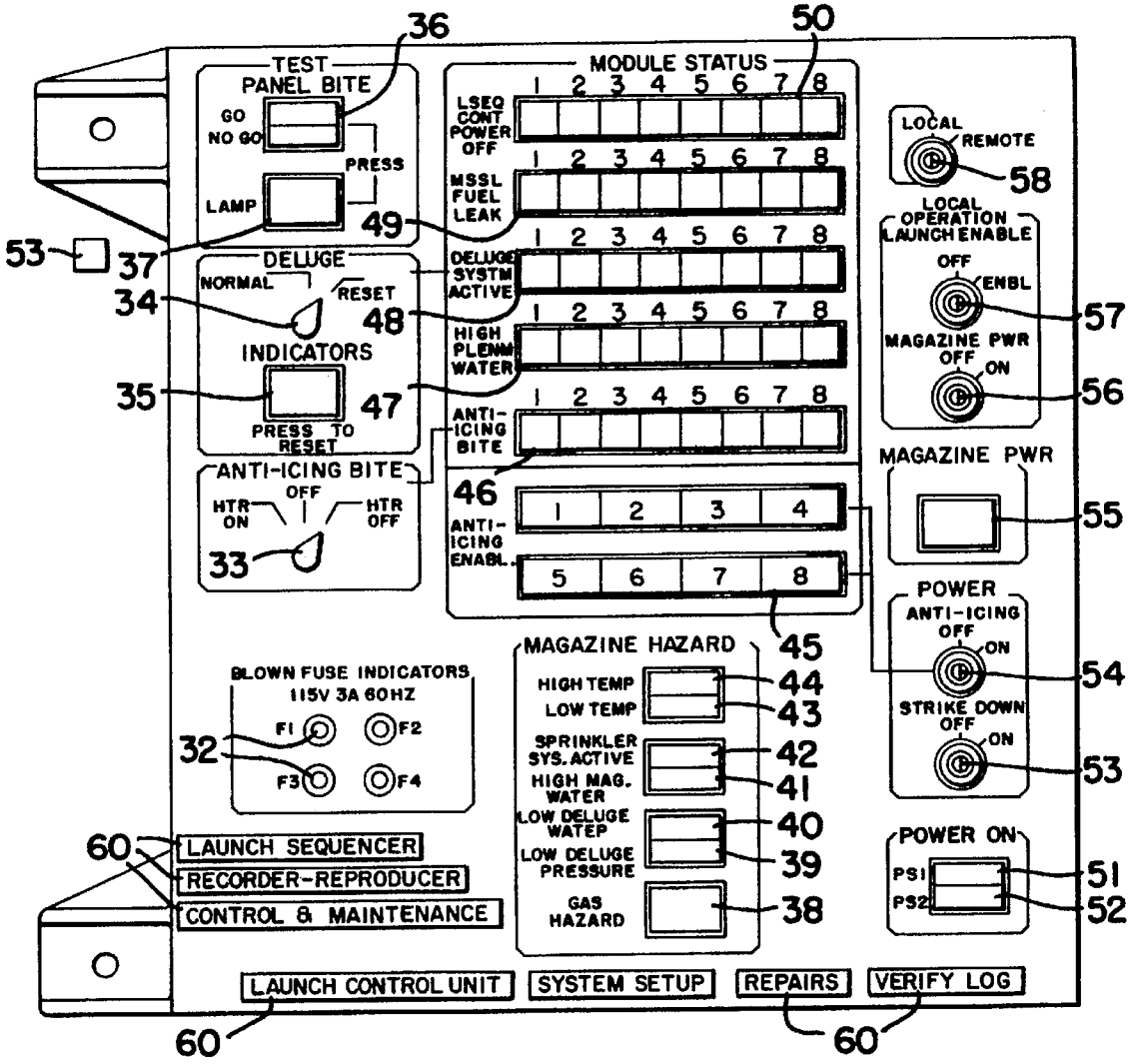
FIG. 3 is an illustration of a screen display when the preferred embodiment is executing a status panel unit.

FIG. 3 is an illustration of a screen display when the preferred embodiment is executing the status panel unit 13. In the preferred embodiment, the status panel unit 13 displays a status panel used in a vertical launch missile system. The display illustrates blown fuse indicators 32, an anti-icing bite switch 33, a deluge switch 34, an indicator reset switch 35, a panel bite test go/no go switch 36, a panel bite test lamp switch 37, a gas hazard indicator 38, a low deluge pressure indicator 39, a low deluge water indicator 40, a high magazine water indicator 41, a sprinkler system active indicator 42, a low temperature indicator 43, a high temperature indicator 44, an anti-icing enable indicator 45, an anti-icing bite indicator 46, a high plenum water indicator 47, a deluge system active indicator 48, a missile fuel leak indicator 49, an LSEQ cont power off indicator 50, a first power supply indicator 51, a second power supply indicator 52, a strike down switch 53, an anti-icing power switch 54, a magazine power indicator 55, a magazine power switch 56, a launch enable switch 57, and a local/remote control switch 58. At the bottom of the display are buttons 60 for going to the other units. The display also provides a warning button 53.

Figure 4:
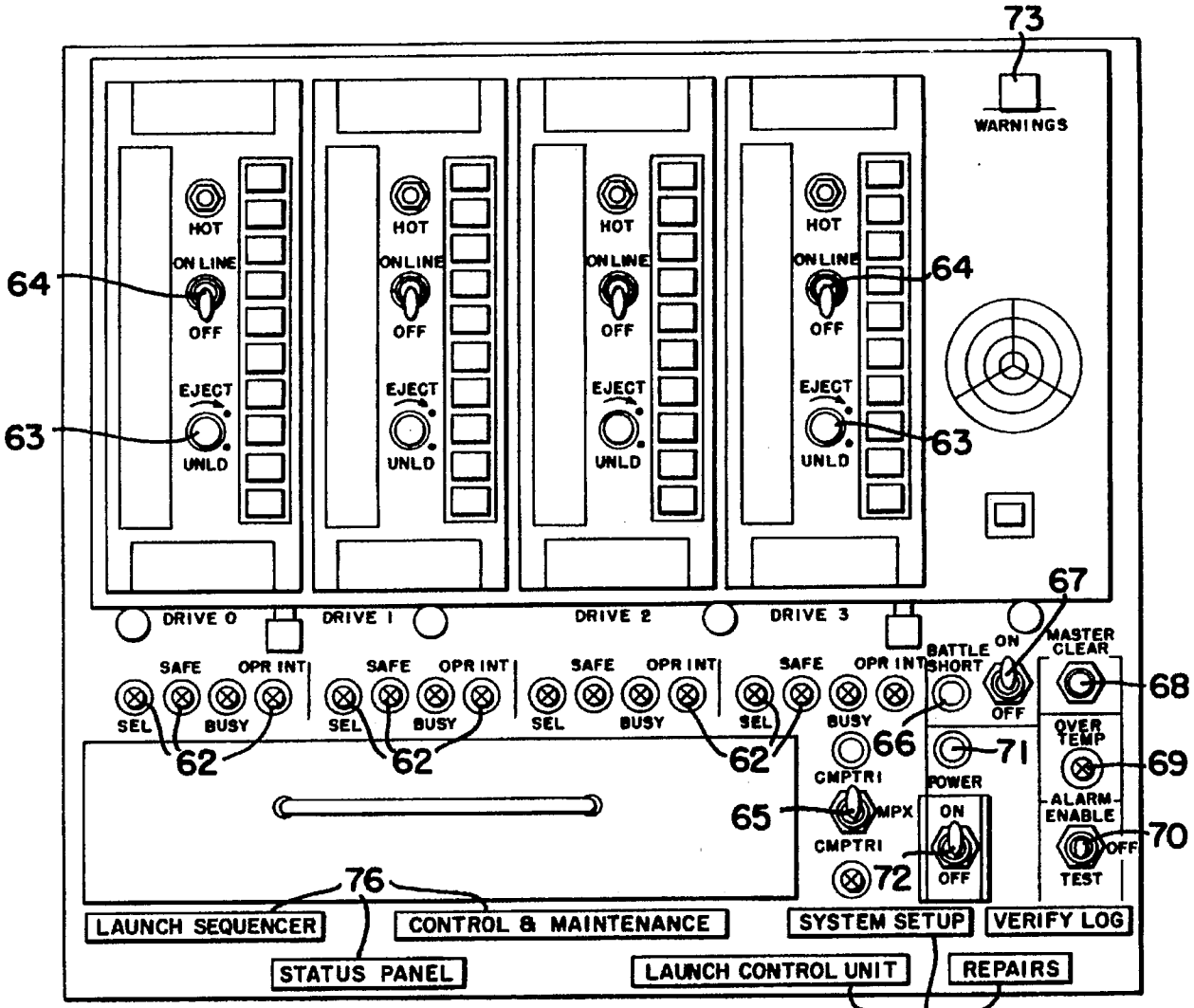
FIG. 4 is an illustration of a screen display when the preferred embodiment is executing a recorder-reproducer unit.

FIG. 4 is an illustration of a screen display when the preferred embodiment is executing the recorder-reproducer unit 14. In the preferred embodiment, the recorder-reproducer unit 14 displays a recorder-reproducer panel used in a vertical launch missile system. The display illustrates status lights 62 for drives 0, 1, 2, and 3, eject/unload switches 63 for drives 0, 1, 2, and 3, online/offline switches 64 for drives 0, 1, 2, and 3, a computer designation switch 65, a battle short indicator 66, a battle short switch 67, a master clear indicator 68, a over temperature indicator 69, and alarm enable switch 70, a power indicator 71, and a power switch 72. At the bottom of the display are buttons 76 for going to the other units. The display also provides a warning button 73.

Figure 5:
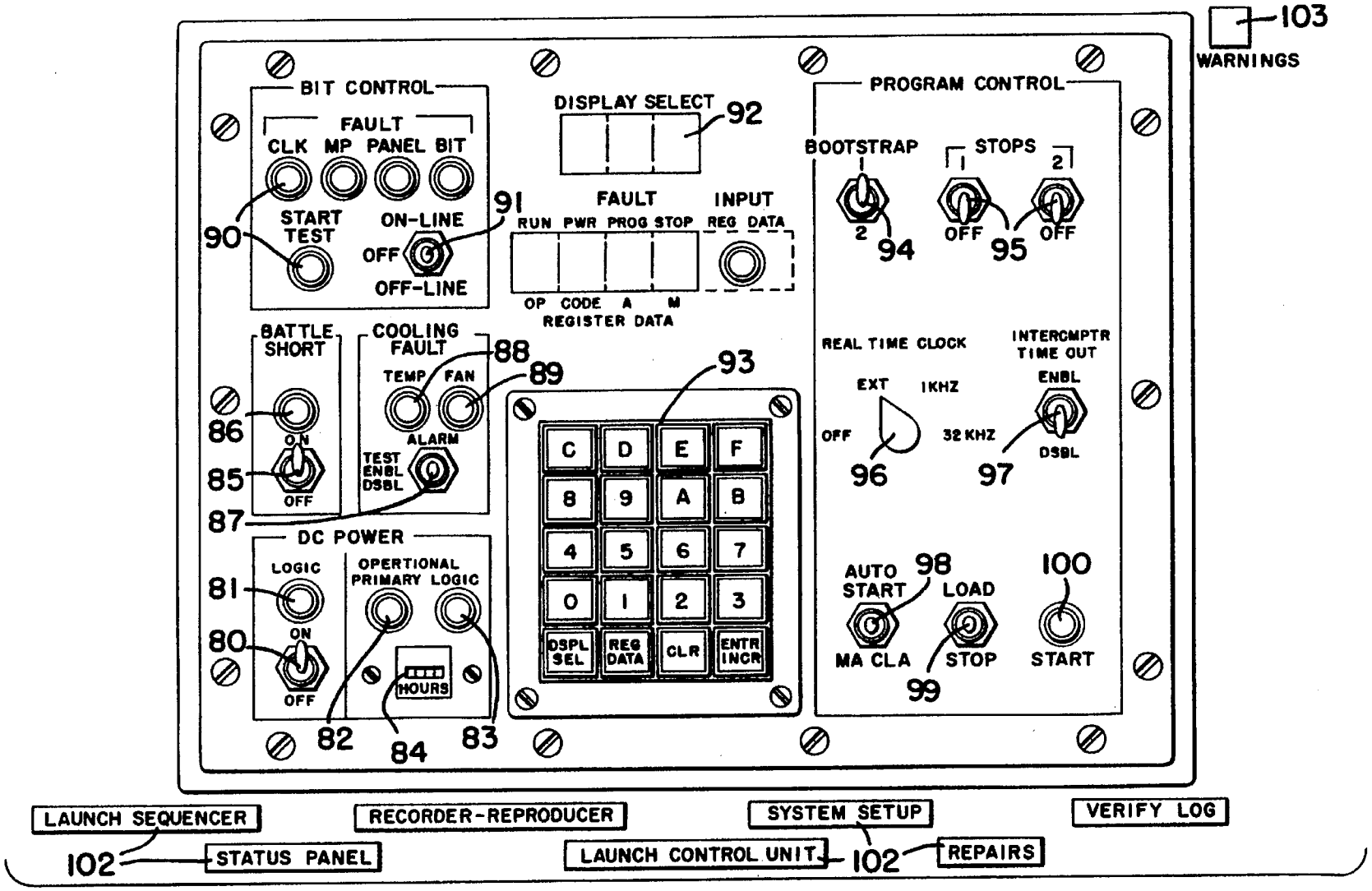
FIG. 5 is an illustration of a screen display when the preferred embodiment is executing a control and maintenance unit.
Figure 5:
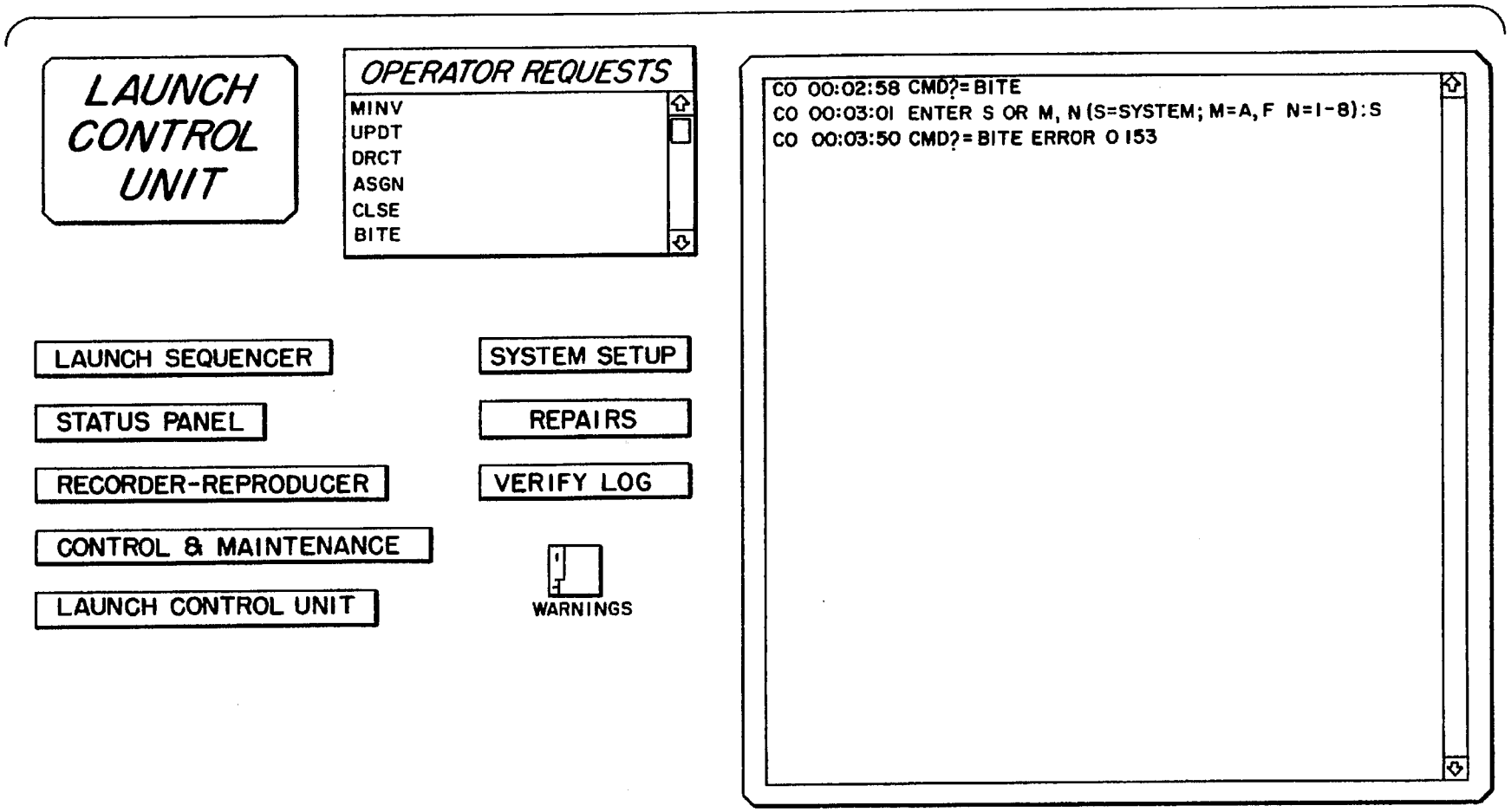

FIG. 5 is an illustration of a screen display when the preferred embodiment is executing the control and maintenance unit 15. In the preferred embodiment, the control and maintenance unit 15 displays a control and maintenance panel used in a vertical launch missile system. The display illustrates a DC power switch 80 and logic indicator 81, a DC power primary indicator 82 and logic indicator 83, a timer 84, a battle short switch 85 and indicator 86, a cooling fault switch 87 and temperature 88 and fan 89 indicators, bit control fault indicators 90 and a switch 91, a display select indicator 92, a keypad 93, a bootstrap switch 94, stop switches 95, a real time clock switch 96, an intercomputer time out s switch 97, an autostart switch 98, a load switch 99, and a start indicator 100. At the bottom of the display are buttons 102 for going to the other units. The display also provides a warning button 103.

Figure 7:
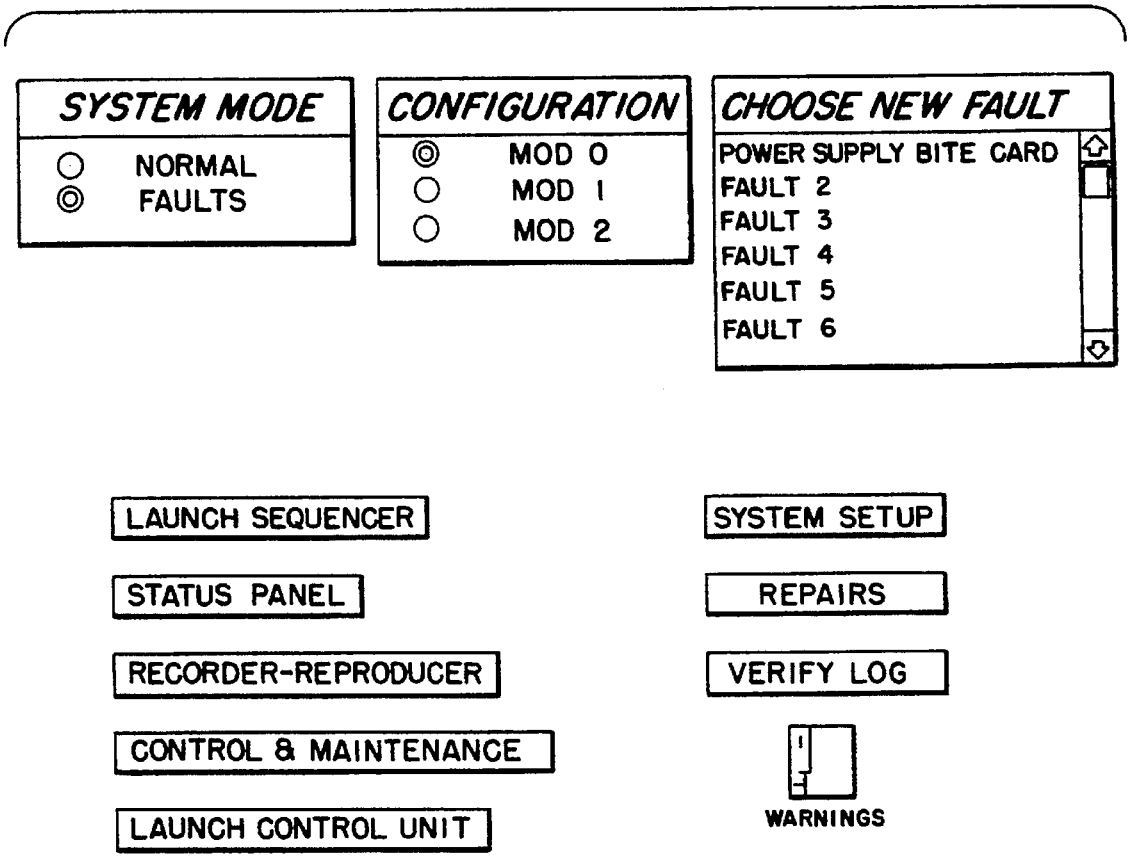
FIG. 7 is an illustration of a screen display when the preferred embodiment is executing a system setup unit.
Figure 12:
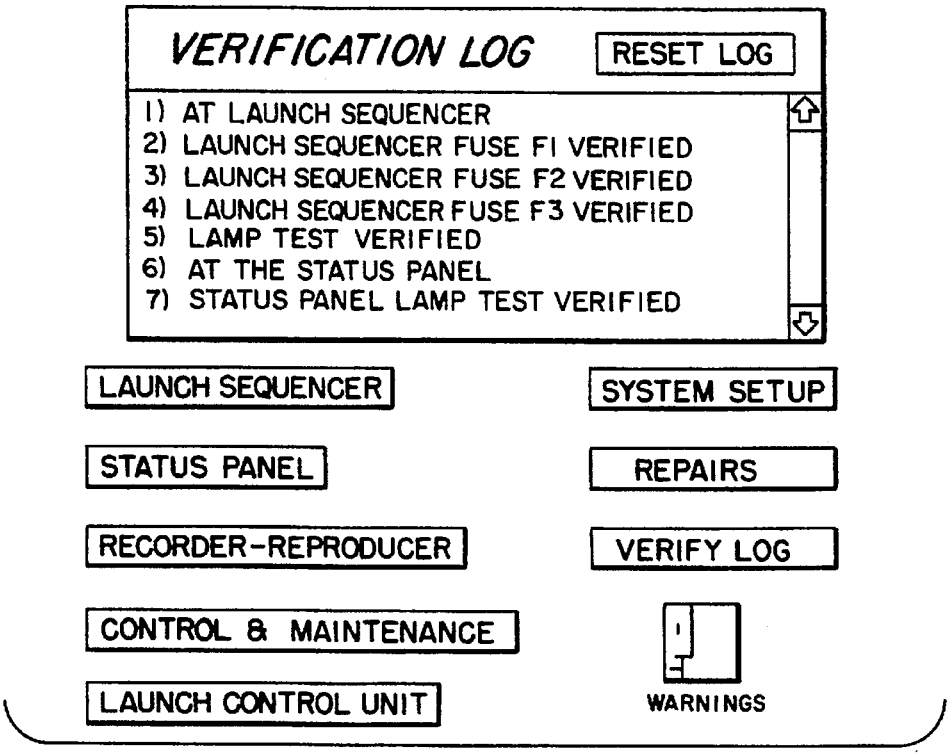
FIG. 12 is an illustration of a screen display when the preferred embodiment is executing a system setup unit.

FIG. 6 is an illustration of a screen display when the preferred embodiment is executing the launch control unit 16. FIG. 7 is an illustration of a screen display when the preferred embodiment is executing the system setup unit 17. FIGS. 8 to 11 are illustrations of screen displays when the preferred embodiment is executing the repair unit 18. FIG. 12 is an illustration of a screen display when the preferred embodiment is executing the system setup unit 19.

Figure 14:
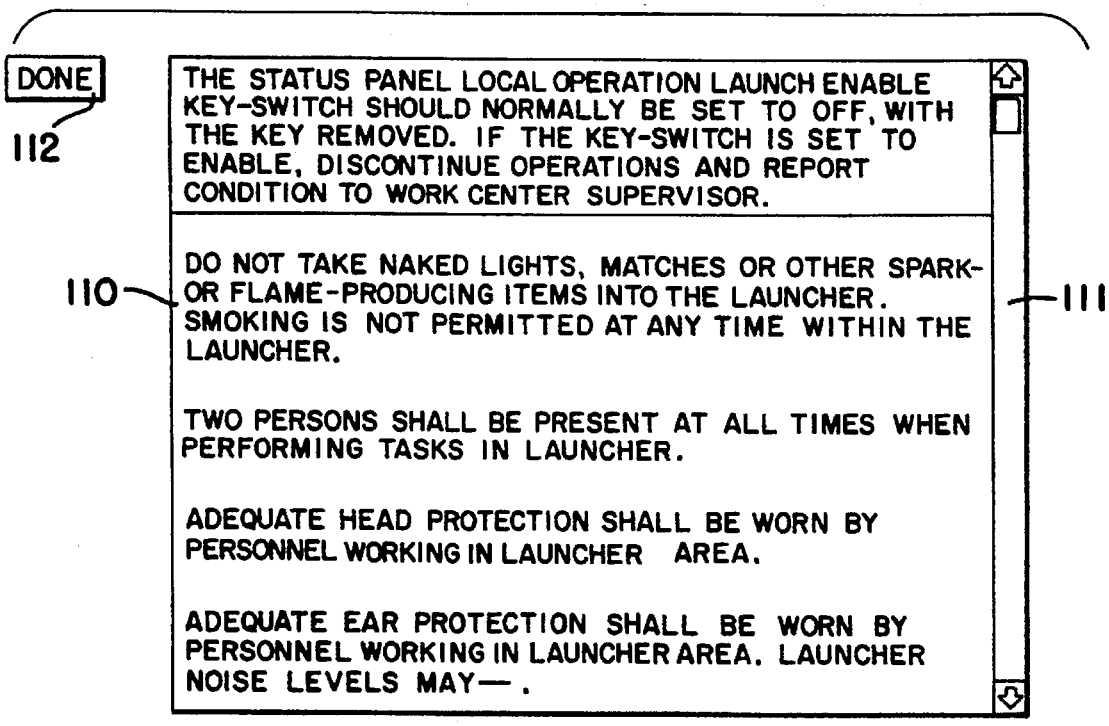
FIG. 14 is an illustration of a screen display of the warning tool of the preferred embodiment.
Figure 13:
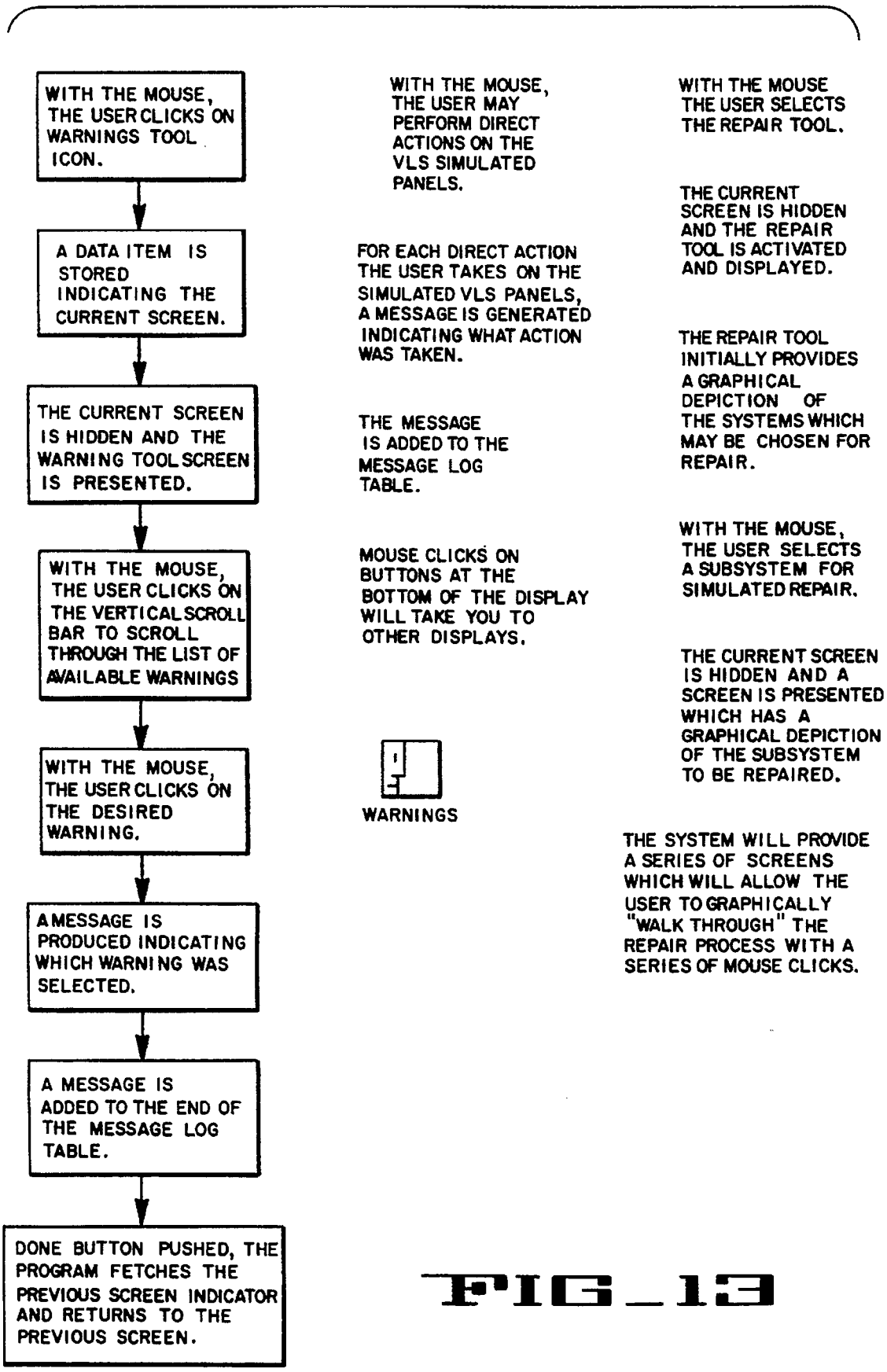
FIG. 13 is a schematic diagram of the warning sequence used by the preferred embodiment of the invention.

In operation of the preferred embodiment, the user would be at a Macintosh II, which would be running a program such as VSOFT. The user may be in the launch sequencer unit 12, which causes the launch sequencer display to appear on the monitor as shown in FIG. 2. If the operator moves a cursor over to select the warning button 27 the sequence as illustrated in FIG. 13 occurs. When the warning button 27 is selected, data is stored in a log memory in the central as processing unit for indicating the current display screen. The current screen is hidden and a warning tool screen is presented. FIG. 14 illustrates a warning tool screen. As shown in FIG. 14, the warning tool screen has a scrollable window 110 with information for the operator. The operator may use a vertical scroll bar 111 to scroll through a list of warnings. The operator selects the desired warning, and data is stored in a message log table indicating the message selected. The operator selects a "Done" button 112. The computer looks at the data in the address for indicating the current display screen, to determine a which screen is indicated by the data.

The computer returns to the screen indicated by the data. The operator could select one of the buttons 30 at the bottom of the display to go to another unit and display. By selecting a switch such as the control switch 26 the operator can move the switch from one position to another, such as from off to F1 or F2. As a result of moving the switches or other changes in status, the indicators such as the missile fuel leak cell number indicator 24 change color or lighting. By clicking on an indicator such as the missile fuel leak cell number indicator 24 the program sends information indicating which indicator was selected and the time it was selected to a verification log.

The status panel unit 13, the recorder-reproducer unit 14, and the control and maintenance unit 15 have similar warning buttons, switches, indicators, and verification steps.

In the launch control unit 16 the operator is able to type commands directly.

In the system set up unit 17, the operator is able to set system parameters such as whether the system acts normally or whether acts with system faults. The operator can also select the configuration and the faults.

Figure 8:
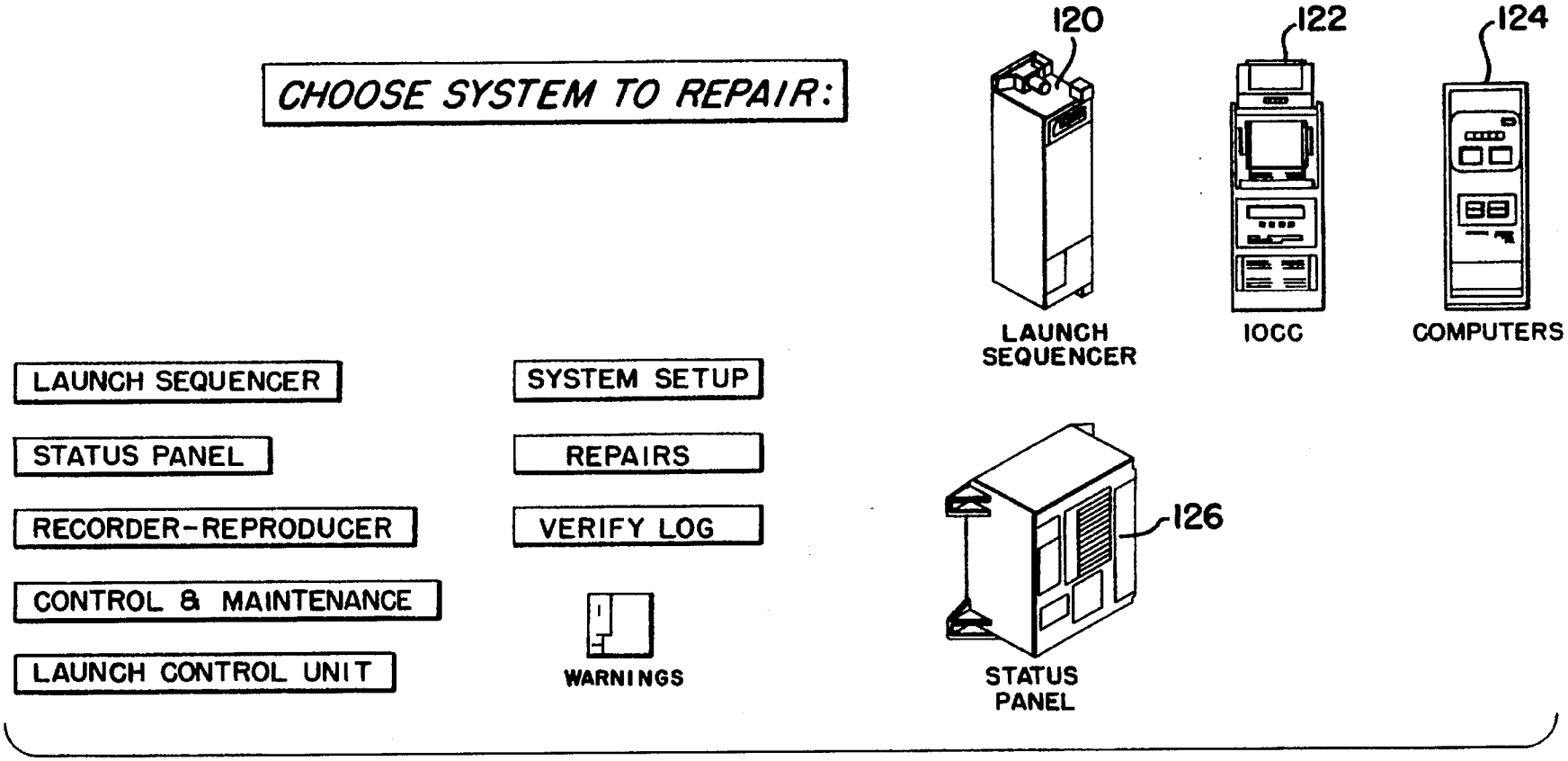
FIG. 8 is an illustration of a screen display when the preferred embodiment is executing a repair unit.
Figure 9:
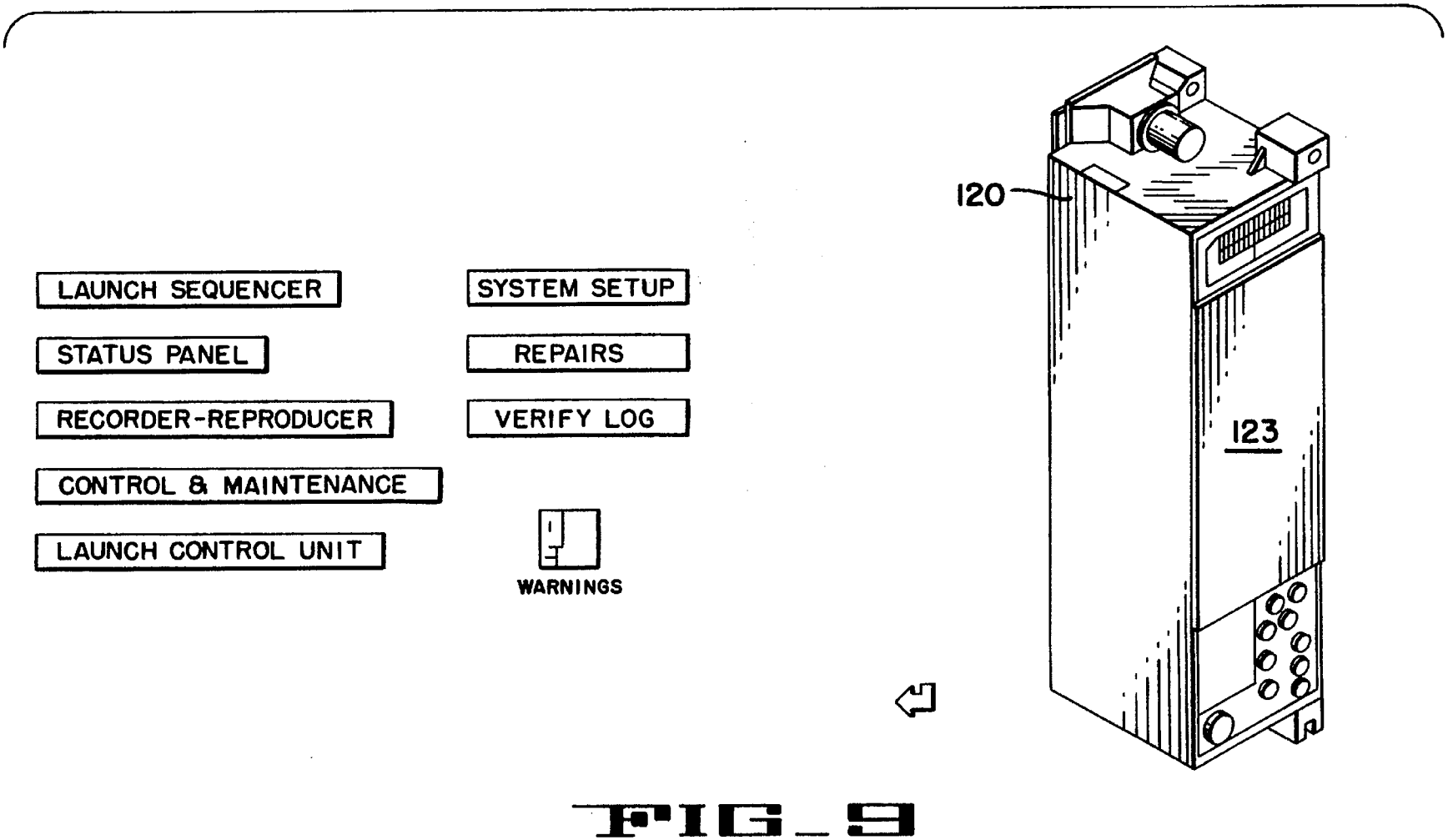
FIG. 9 is an illustration of another screen display when the preferred embodiment is executing the repair unit.
Figure 10:
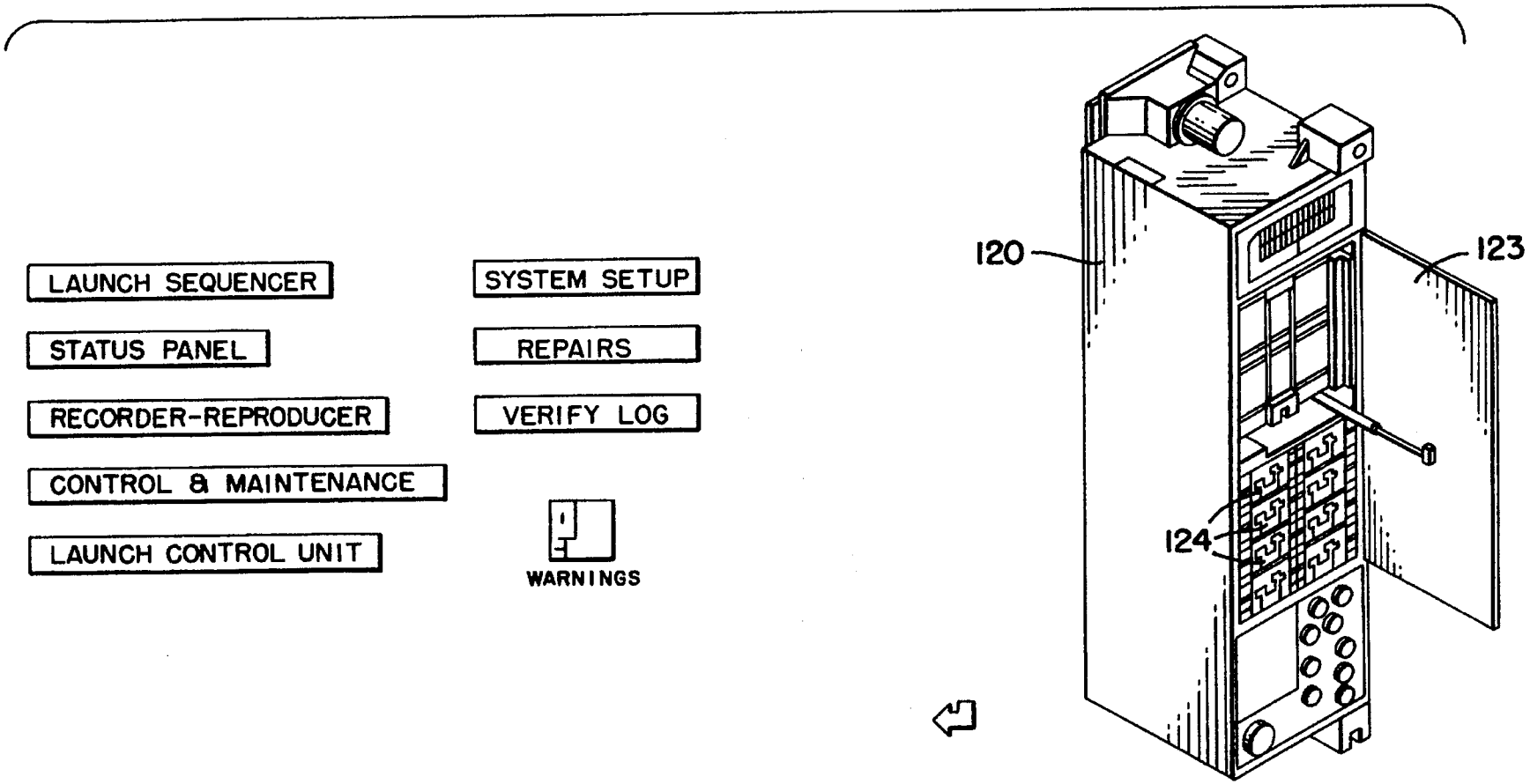
FIG. 10 is an illustration of another screen display when the preferred embodiment is executing the repair unit.
Figure 11:
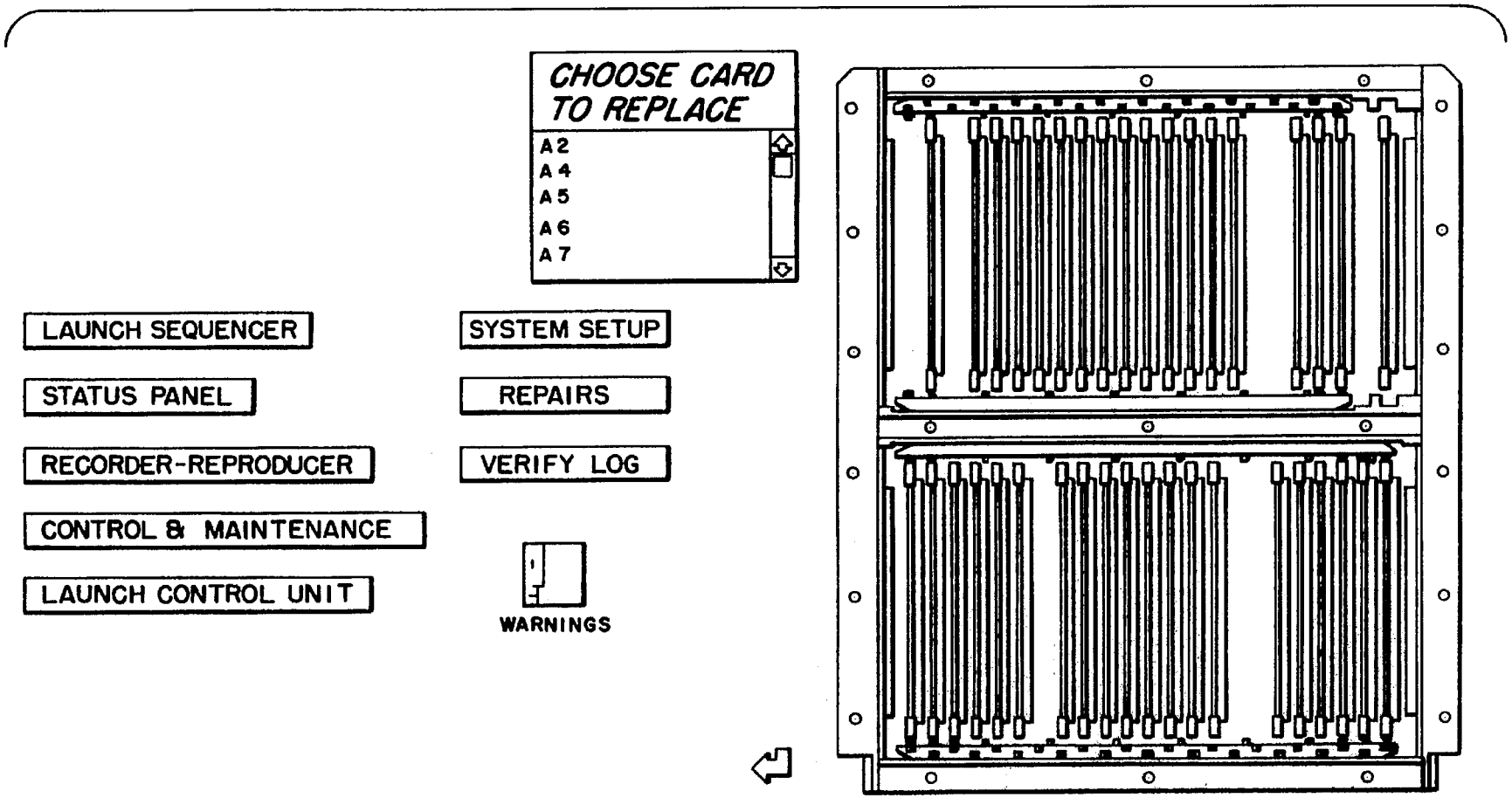
FIG. 11 is an illustration of another screen display when the preferred embodiment is executing the repair unit.

If a system fault is indicated by the simulator program, the operator would go to the repair unit 18. In the repair mode, the unit to displays a choice of items to such as a launch sequencer 120, an input output communications control 122, the general computers 124, and the status panel 126 as shown in FIG. 8. If the launch sequencer 120 is selected, then the unit displays an enlarged view of the launch sequencer 120 as shown in FIG. 9. If the door 123 on the back panel of the launch sequencer 120 is selected, then the unit displays an enlarged view of the launch sequencer 120 with the door 123 opened as illustrated in FIG. 10. If a panel of cards 124 is selected, then the unit displays an enlarged view of the selected panel of cards 124 and a window to specify which of the cards the operator desires to replace. When a card is selected, the computer sends information to the verification log to indicate which board the operator chose to replace.

Once the operator has completed an exercise simulating a launch of a missile or the repair of the system, the operator or an evaluator may review the actions taken by entering the verify log unit 19. The verify log unit 19 provides a display with a scrollable window indicating the steps followed by the operator. The operator may use such information to determine if any mistakes were made and to teach the operator the proper actions. The evaluator may use the verification log to determine the operator's ability.

The invention may be used in other embodiments. The warning buttons and displays provide a useful teaching tool. The recording of the operator's actions, especially the selecting of various indicators provides useful evaluation information by recording the operator's actions. Prior art devices did not record whether or not the operator checked various indicators. Since the invention requires the operator to click on various indicators the verify log is able to provide information as to which indicators were checked. This log can show that the operator did not look at the required indicators, or the operator looked at indicators of which there was no need to check.

Copyright FMC Corporation, 1992

```
*****************************************************************
************
* *
** ID 1 --> stack "VMOTS Demonstrator"
* *
```

-7-

```
*************************************************************
************

on docdThings bgNum, cdNum, thingType, thingTypes, thingToDo,
sourceobject
  do "put the number of cd" && thingtypes && "in cd" && cdNum &&
"of bg" && bgNum ¬
&& "into count"
  repeat with i = 1 to count
    send thingToDo && quote & "cd" && thingtype && i && "of" &&
"cd" && cdnum && "of bg" && ¬ bgNum & quote to sourceobject
  end repeat
end docdThings

on doCard bgnum, cdNum, thingToDo, sourceobject
 send thingToDo && quote & "card" && cdNum &&"of bg" && bgNum &
                        quote to sourceObject
  docdThings bgNum, cdNum, btn, btns, thingToDo, sourceobject
    docdThings bgNum, cdNum, fld, flds, thingToDo, sourceobject
  docdThings bgNum, cdNum, wpf, wpfs, thingToDo, sourceobject
  docdThings bgNum, cdNum, dbf, dbfs, thingToDo, sourceobject
  docdThings bgNum, cdNum, pnt, pnts, thingToDo, sourceobject
  docdThings bgNum, cdNum, drw, drws, thingToDo, sourceobject
end doCard

on doBgThings bgNum, thingType, thingTypes, thingToDo, sourceobject
 do "put the number of bg" && thingtypes && "in cd 1 of bg" && bgNum
                        && "into count"
  repeat with i = 1 to count
    send thingToDo && quote & "bg" && thingtype && i && "of cd 1 of
bg" && bgNum & quote ¬ to sourceobject
  end repeat
end doBgThings

on doBackground bgNum, thingToDo, sourceobject
  send thingToDo && quote & "background" && bgNum & quote to
sourceobject
  doBgThings bgNum, btn, btns, thingToDo, sourceobject
        doBgThings bgNum, fld, flds, thingToDo, sourceobject
  doBgThings bgNum, wpf, wpfs, thingToDo, sourceobject doBgThings
  bgNum, dbf, dbfs, thingToDo, sourceobject doBgThings bgNum, pnt,
  pnts, thingToDo, sourceobject doBgThings bgNum, drw, drws,
  thingToDo, sourceobject repeat with i = 1 to the number of cards in
  bg bgnum
    docard bgnum, i, ThingToDo, sourceobject
```

```
  end repeat
end doBackground

on doStack thingToDo, sourceobject
  send thingToDo && "stack" to sourceobject
          repeat with i = 1 to the number of backgrounds
    doBackground i, thingToDo, sourceobject end repeat
end doStack

on openstack
    send mouseUp to card button "Reset Log" of card "Verify Log"
  wait for 2 seconds
  visual effect scroll down slow
  go to card "systemsetup"
end openstack

on mouseUp
  beep
end mouseUp

on logverify verifieditem
  global logcount
 put logcount & ") " & verifieditem into line logcount of card field log
                        of card "Verify Log"
  put logcount + 1 into logcount
end logverify

function clickline clickedfield
  return (((item 2 of the clickLoc) - ¬
              (item 2 of the rect of clickedfield) + ¬
              (the scroll of clickedfield) - 1) div ¬
     (the textHeight of clickedfield)) + 1
end clickline
*****************************************************
************    **
** ID 99 --> bkgnd button "button id 99"
* *
*****************************************************
************

on mouseUp
  hide background paintobject f1
  hide background paintobject f2
  hide background paintobject f3
  hide background paintobject f4
  hide background paintobject f5
```

```
hide background paintobject f6

show background paintobject off

hide background paintobject f1 of card "Lamp Test" hide background
paintobject f2 of card "Lamp Test" hide background paintobject f3
of card "Lamp Test" hide background paintobject f4 of card "Lamp
Test" hide background paintobject f5 of card "Lamp Test" hide
background paintobject f6 of card "Lamp Test"

        show background paintobject off of card "Lamp Test"

  show background paintobject "Fuse Blown" of card "Lamp Test"
end mouseUp
*************************************************************
************    **
** ID 100 --> bkgnd button "button id 100"
* *
*************************************************************
************

on mouseUp
  logverify "Launch Sequencer Fuse F1 Verified."

  hide background paintobject f2
  hide background paintobject f3
  hide background paintobject f4
  hide background paintobject f5
  hide background paintobject f6
  hide background paintobject off

  show background paintobject f1

  hide background paintobject f2 of card "Lamp Test" hide background
  paintobject f3 of card "Lamp Test" hide background paintobject f4
  of card "Lamp Test" hide background paintobject f5 of card "Lamp
  Test" hide background paintobject f6 of card "Lamp Test" hide
  background paintobject off of card "Lamp Test"

        show background paintobject f1 of card "Lamp Test"

  hide background paintobject "Fuse Blown" of card "Lamp Test"
end mouseUp
*************************************************************
************    **
** ID 101 --> bkgnd button "button id 101"
```

-10-

```
* *
*************************************************************
************

on mouseUp
  logverify "Launch Sequencer Fuse F2 Verified."

  hide background paintobject f3
  hide background paintobject f4
  hide background paintobject f5
  hide background paintobject f6
  hide background paintobject off
  hide background paintobject f1

  show background paintobject f2

  hide background paintobject f3 of card "Lamp Test" hide background
  paintobject f4 of card "Lamp Test" hide background paintobject f5
  of card "Lamp Test" hide background paintobject f6 of card "Lamp
  Test" hide background paintobject off of card "Lamp Test" hide
  background paintobject f1 of card "Lamp Test"

        show background paintobject f2 of card "Lamp Test"

    hide background paintobject "Fuse Blown" of card "Lamp Test"
end mouseUp
*************************************************************
************    **
** ID 102 --> bkgnd button "button id 102"
* *
*************************************************************
************

on mouseUp
  logverify "Launch Sequencer Fuse F3 Verified."

  hide background paintobject f4
  hide background paintobject f5
  hide background paintobject f6
  hide background paintobject off
  hide background paintobject f1
  hide background paintobject f2

  show background paintobject f3

  hide background paintobject f4 of card "Lamp Test" hide background
  paintobject f5 of card "Lamp Test" hide background paintobject f6
```

```
of card "Lamp Test" hide background paintobject off of card "Lamp
Test" hide background paintobject f1 of card "Lamp Test" hide
background paintobject f2 of card "Lamp Test"

        show background paintobject f3 of card "Lamp Test"

   hide background paintobject "Fuse Blown" of card "Lamp Test"
end mouseUp
*************************************************************
************    **
** ID 103 --> bkgnd button "button id 103"
* *
*************************************************************
************

on mouseUp
        logverify "Launch Sequencer Fuse F4 Verified."

hide background paintobject f5
hide background paintobject f6
hide background paintobject off
hide background paintobject f1
hide background paintobject f2
hide background paintobject f3

show background paintobject f4

hide background paintobject f5 of card "Lamp Test" hide background
paintobject f6 of card "Lamp Test" hide background paintobject off
of card "Lamp Test" hide background paintobject f1 of card "Lamp
Test" hide background paintobject f2 of card "Lamp Test" hide
background paintobject f3 of card "Lamp Test"

        show background paintobject f4 of card "Lamp Test"

   hide background paintobject "Fuse Blown" of card "Lamp Test"
end mouseUp
*************************************************************
************    **
** ID 104 --> bkgnd button "button id 104"
* *
*************************************************************
************

on mouseUp
  logverify "Launch Sequencer Fuse F5 Verified."
```

```
    hide background paintobject f6
    hide background paintobject off
    hide background paintobject f1
    hide background paintobject f2
    hide background paintobject f3
    hide background paintobject f4

    show background paintobject f5

    hide background paintobject f6 of card "Lamp Test" hide background
    paintobject off of card "Lamp Test" hide background paintobject f1
    of card "Lamp Test" hide background paintobject f2 of card "Lamp
    Test" hide background paintobject f3 of card "Lamp Test" hide
    background paintobject f4 of card "Lamp Test"

          show background paintobject f5 of card "Lamp Test"

      hide background paintobject "Fuse Blown" of card "Lamp Test"
end mouseUp
*****************************************************************
************    **
** ID 105 --> bkgnd button "button id 105"
* *
*****************************************************************
************

on mouseUp
  logverify "Launch Sequencer Fuse F6 Verified."

  hide background paintobject off
  hide background paintobject f1
  hide background paintobject f2
  hide background paintobject f3
  hide background paintobject f4
  hide background paintobject f5

  show background paintobject f6

  hide background paintobject off of card "Lamp Test" hide
  background paintobject f1 of card "Lamp Test" hide background
  paintobject f2 of card "Lamp Test" hide background paintobject f3
  of card "Lamp Test" hide background paintobject f4 of card "Lamp
  Test" hide background paintobject f5 of card "Lamp Test"

          show background paintobject f6 of card "Lamp Test"

      hide background paintobject "Fuse Blown" of card "Lamp Test"
```

```
end mouseUp
*************************************************************
************    **
** ID 118 --> bkgnd button "MCP Bite Button"
* *
*************************************************************
************

on mouseUp
  if the visible of background paintobject "LSEQ Bite" then
    hide background paintobject "LSEQ Bite"
    show background paintobject "MCP Bite" else
    hide background paintobject "MCP Bite" show background
    paintobject "LSEQ Bite"
  end if
end mouseUp
*************************************************************
************    **
** ID 123 --> bkgnd button "Bite On/Reset Button"
* *
*************************************************************
************

on mouseUp
  show background paintobject "Bite On/Reset"
          hide background button "Bite On/Reset Button"
  show background button "Bite Read Button"
    if the visible of background paintobject "LSEQ Bite" then wait
    for 3 seconds
  else
    wait for 5 seconds
  end if
  show background paintobject "Bite Read"
      if the visible of background paintobject "lseq bite" then
    if the hilite of card button faults of card systemsetup then show
      background paintobject "failure code d"
      show background paintobject "failure code g"
    end if
  end if
end mouseUp
*************************************************************
************    **
** ID 124 --> bkgnd button "Bite Read Button"
```

```
* *
*************************************************************
************

on mouseUp
  hide background paintobject "failure code a"
            hide background paintobject "failure code b"
  hide background paintobject "failure code c" hide background
  paintobject "failure code d" hide background paintobject "failure
  code e" hide background paintobject "failure code f" hide
  background paintobject "failure code g"
  hide background paintobject "failure code h" hide background button
  "Bite Read Button" hide background paintobject "Bite On/Reset"
  hide background paintobject "Bite Read"
show background button "Bite On/Reset Button"
end mouseUp
*************************************************************
************    **
** ID 147 --> bkgnd button "Lamp Test Button"
* *
*************************************************************
************

on mouseUp
  logverify "Lamp Test Verified."

  go to card "Lamp Test"
  go to card "Launch Sequencer"
end mouseUp
*************************************************************
************    **
** ID 153 --> bkgnd button "Verify Log"
* *
*************************************************************
************

on mouseUp
  go to card "Verify Log"
end mouseUp
*************************************************************
************    **
** ID 155 --> bkgnd button "Over Temp Button"
* *
*************************************************************
************
```

- 15 -

```
on mouseUp
  logverify "Over Temp Verified."
  answer "Over Temp verification has been logged." with "OK"
end mouseUp
*************************************************************
************    **
** ID 156 --> bkgnd button "24V Button"
* *
*************************************************************
************

on mouseUp
  logverify "24V Indicator Verified."
   answer "24V Indicator verification has been logged." with "OK"
end mouseUp
*************************************************************
************    **
** ID 157 --> bkgnd button "5V Button"
* *
*************************************************************
************

on mouseUp
  logverify "5V Indicator Verified."
    answer "5V Indicator verification has been logged." with "OK"
end mouseUp
*************************************************************
************    **
** ID 158 --> bkgnd button "LSEQ ID Button"
* *
*************************************************************
************

on mouseUp
  logverify "LSEQ ID Indicator Verified."
 answer "LSEQ ID Indicator verification has been logged." with "OK"
end mouseUp
*************************************************************
************
* *
** ID 159 --> bkgnd button "Restrained Firing Cell Button"
* *
*************************************************************
************

on mouseUp
```

```
  logverify "Restrained Firing Cell Indicators Verified."
   answer "Restrained Firing Cell Indicators verification has been
                              logged." with "OK"
end mouseUp
*************************************************************
************
* *
** ID 160 --> bkgnd button "Bite Failure Code Button"
* *
*************************************************************
************

on mouseUp
  logverify "Bite Failure Code Indicators Verified."
 answer "Bite Failure Code Indicators verification has been logged."
                              with "OK"
end mouseUp
*************************************************************
************
* *
** ID 161 --> bkgnd button "Missile Fuel Leak Button"
* *
*************************************************************
************

on mouseUp
  logverify "Missile Fuel Leak Cell Indicators Verified."
   answer "Missile Fuel Leak Cell Indicators verification has been
                              logged." with "OK"
end mouseUp
*************************************************************
************
* *
** ID 164 --> bkgnd button "System Setup"
* *
*************************************************************
************

on mouseUp
  go to card "systemsetup"
end mouseUp
*************************************************************
************
* *
** ID 166 --> bkgnd button "Status Panel"
```

```
* *
*************************************************************
************

on mouseUp
  logverify "At the status panel."
  go to card "status panel"
end mouseUp
*************************************************************
************    **
** ID 168 --> bkgnd button "Repairs"
* *
*************************************************************
************

on mouseUp
  go to card repair
end mouseUp
*************************************************************
************    **
** ID 169 --> bkgnd button "Recorder-Reproducer"
* *
*************************************************************
************

on mouseUp
  logverify "At the Recorder-Reproducer." go to card "Recorder
  Reproducer"
end mouseUp
*************************************************************
************    **
** ID 170 --> bkgnd button "Control & Maintainence"
* *
*************************************************************
************

on mouseUp
  logverify "At the Control & Maintainence panel."
  go to card "Control & Maintainence"
end mouseUp
*************************************************************
************    **
** ID 171 --> bkgnd button "Launch Control Unit"
* *
*************************************************************
************
```

```
on mouseUp
  logverify "At LCU"
  go to card LCU
end mouseUp
*************************************************************
************
* *
** ID 143 --> bkgnd dbfield "Digital Display"
* *
*************************************************************
************

on mouseUp
  logverify "Module Number Indicator Verified."
 answer "Module Number Indicator verification has been logged." with
                                    "OK"
end mouseUp
*************************************************************
************
* *
** ID 82 --> bkgnd paintobject "Off"
* *
*************************************************************
************

on mouseUp
  logverify "Launch Sequencer Fuse F1 Verified."

  hide background paintobject off
  show background paintobject f1
  hide background paintobject off of card "Lamp Test" show
  background paintobject f1 of card "Lamp Test"
hide background paintobject "Fuse Blown" of card "Lamp Test"
end mouseUp
*************************************************************
***********    **
** ID 83 --> bkgnd paintobject "F1"
* *
*************************************************************
************

on mouseUp
  logverify "Launch Sequencer Fuse F2 Verified."

  hide background paintobject f1
  show background paintobject f2
```

```
  hide background paintobject f1 of card "Lamp Test" show
  background paintobject f2 of card "Lamp Test"
end mouseUp
*************************************************************
************    **
** ID 84 --> bkgnd paintobject "F2"
* *
*************************************************************
************

on mouseUp
  logverify "Launch Sequencer Fuse F3 Verified."

  hide background paintobject f2
  show background paintobject f3
  hide background paintobject f2 of card "Lamp Test" show
  background paintobject f3 of card "Lamp Test"
end mouseUp
*************************************************************
************    **
** ID 85 --> bkgnd paintobject "F3"
* *
*************************************************************
************

on mouseUp
  logverify "Launch Sequencer Fuse F4 Verified."

  hide background paintobject f3
  show background paintobject f4
  hide background paintobject f3 of card "Lamp Test" show
  background paintobject f4 of card "Lamp Test"
end mouseUp
*************************************************************
************    **
** ID 86 --> bkgnd paintobject "F4"
* *
*************************************************************
************

on mouseUp
  logverify "Launch Sequencer Fuse F5 Verified."

  hide background paintobject f4
  show background paintobject f5
```

```
  hide background paintobject f4 of card "Lamp Test" show
  background paintobject f5 of card "Lamp Test"
end mouseUp
*************************************************************
************    **
** ID 87 --> bkgnd paintobject "F5"
* *
*************************************************************
************

on mouseUp
  logverify "Launch Sequencer Fuse F6 Verified."

  hide background paintobject f5
  show background paintobject f6
  hide background paintobject f5 of card "Lamp Test" show
  background paintobject f6 of card "Lamp Test"
end mouseUp
*************************************************************
************    **
** ID 88 --> bkgnd paintobject "F6"
* *
*************************************************************
************

on mouseUp
  hide background paintobject f6
  show background paintobject off
  hide background paintobject f6 of card "Lamp Test" show
  background paintobject off of card "Lamp Test"
show background paintobject "Fuse Blown" of card "Lamp Test"
end mouseUp
*************************************************************
************
* *
** ID 12529 --> card "Launch Sequencer"
* *
*************************************************************
************


*************************************************************
************    **
** ID 20 --> card button "Warnings"
```

```
* *
*************************************************************
************

on mouseUp
  push this card
  go to card warnings
end mouseUp
*************************************************************
************    **
** ID 4008 --> card "Lamp Test"
* *
*************************************************************
************

on mouseUp
  go card "Launch Sequencer"
end mouseUp

*************************************************************
************    **
** ID 16 --> card button "Status Panel"
* *
*************************************************************
************

on mouseUp
  logverify "At the status panel."
  go to card "status panel"
end mouseUp
*************************************************************
************    **
** ID 17 --> card button "Recorder-Reproducer"
* *
*************************************************************
************

on mouseUp
  logverify "At the Recorder-Reproducer."
  go to card "Recorder Reproducer"
end mouseUp
*************************************************************
************    **
** ID 18 --> card button "Control & Maintainence"
```

```
* *
*************************************************************
************

on mouseUp
  logverify "At the Control & Maintainence panel."
  go to card "Control & Maintainence"
end mouseUp
*************************************************************
***********    **
** ID 19 --> card button "Launch Control Unit"
* *
*************************************************************
************

on mouseUp
  logverify "At LCU"
  go to card LCU
end mouseUp
*************************************************************
***********    **
** ID 20 --> card button "System Setup"
* *
*************************************************************
************

on mouseUp
  go to card "systemsetup"
end mouseUp
*************************************************************
***********    **
** ID 21 --> card button "Repairs"
* *
*************************************************************
************

on mouseUp
  go to card repair
end mouseUp
*************************************************************
***********    **
** ID 22 --> card button "Verify Log"
* *
*************************************************************
************
```

```
on mouseUp
  go to card "Verify Log"
end mouseUp
*************************************************************
************    **
** ID 23 --> card button "Warnings"
* *
*************************************************************
************

on mouseUp
  push this card
  go to card warnings
end mouseUp
*************************************************************
************    **
** ID 5 --> bkgnd button "Launch Sequencer"
* *
*************************************************************
************

on mouseUp
  logverify "At launch sequencer."

  go to card "launch sequencer"
end mouseUp
*************************************************************
************    **
** ID 7 --> bkgnd button "Recorder-Reproducer"
* *
*************************************************************
************

on mouseUp
  logverify "At the Recorder-Reproducer."

  go to card "Recorder Reproducer"
end mouseUp
*************************************************************
************    **
** ID 8 --> bkgnd button "Control & Maintainence"
* *
*************************************************************
************

on mouseUp
```

```
  logverify "At the Control & Maintainence panel."
  go to card "Control & Maintainence"
end mouseUp
*************************************************************
************    **
** ID 9 --> bkgnd button "Repairs"
* *
*************************************************************
************

on mouseUp
  go to card repair
end mouseUp
*************************************************************
************    **
** ID 10 --> bkgnd button "System Setup"
* *
*************************************************************
************

on mouseUp
  go to card "systemsetup"
end mouseUp
*************************************************************
************    **
** ID 12 --> bkgnd button "Verify Log"
* *
*************************************************************
************

on mouseUp
  go to card "Verify Log"
end mouseUp
*************************************************************
************    **
** ID 13 --> bkgnd button "Launch Control Unit"
* *
*************************************************************
************

on mouseUp
  logverify "At LCU"
  go to card LCU
end mouseUp
*************************************************************
************    **
```

```
** ID 14 --> bkgnd button "Warnings"
* *
*************************************************************
************

on mouseUp
  push this card
  go to card warnings
end mouseUp
*************************************************************
************    **
** ID 6 --> card button "button id 6"
* *
*************************************************************
************

on mouseUp
  hide card paintobject "Anti Icing Bite Htr Off"
  hide card paintobject "Anti Icing Bite Off"
  show card paintobject "Anti Icing Bite Htr On"

  hide card paintobject "Anti Icing Bite Htr Off" of card "status panel
  lamp test" hide card paintobject "Anti Icing Bite Off" of card
  "status panel lamp test" show card paintobject "Anti Icing Bite Htr
  On" of card "status panel lamp test"
end mouseUp
*************************************************************
************
* *
** ID 7 --> card button "button id 7"
* *
*************************************************************
************

on mouseUp
  hide card paintobject "Anti Icing Bite Htr Off"
  hide card paintobject "Anti Icing Bite Htr On"
  show card paintobject "Anti Icing Bite Off"

  hide card paintobject "Anti Icing Bite Htr Off" of card "status panel
  lamp test" hide card paintobject "Anti Icing Bite Htr On" of card
  "status panel lamp test" show card paintobject "Anti Icing Bite
  Off" of card "status panel lamp test"
end mouseUp
*************************************************************
************
```

```
* *
** ID 8 --> card button "button id 8"
* *
*************************************************************
************

on mouseUp
  hide card paintobject "Anti Icing Bite Htr On"
  hide card paintobject "Anti Icing Bite Off"
  show card paintobject "Anti Icing Bite Htr Off"

  hide card paintobject "Anti Icing Bite Htr On" of card "status panel
  lamp test" hide card paintobject "Anti Icing Bite Off" of card
  "status panel lamp test" show card paintobject "Anti Icing Bite Htr
  Off" of card "status panel lamp test"
end mouseUp
*************************************************************
************
* *
** ID 11 --> card button "button id 11"
* *
*************************************************************
************

on mouseUp
  hide card paintobject "Deluge Reset"
  show card paintobject "Deluge Normal"

  hide card paintobject "Deluge Reset" of card "status panel lamp
  test" show card paintobject "Deluge Normal" of card "status panel
  lamp test"
end mouseUp
*************************************************************
************
* *
** ID 12 --> card button "button id 12"
* *
*************************************************************
************

on mouseUp
  hide card paintobject "Deluge Normal"
  show card paintobject "Deluge Reset"
```

```
    hide card paintobject "Deluge Normal" of card "status panel lamp
    test" show card paintobject "Deluge Reset" of card "status panel
    lamp test"
  end mouseUp
  ************************************************************
  ************
  * *
  ** ID 25 --> card button "button id 25"
  * *
  ************************************************************
  ************

  on mouseUp
    logverify "Control Local/Remote is set to local."

    hide card drawobject "control remote"
    show card drawobject "control local"

    hide card drawobject "control remote" of card "status panel lamp
    test" show card drawobject "control local" of card "status panel
    lamp test"
  end mouseUp
  ************************************************************
  ************
  * *
  ** ID 26 --> card button "button id 26"
  * *
  ************************************************************
  ************

  on mouseUp
    logverify "Control Local/Remote is set to remote."

    hide card drawobject "control local"
    show card drawobject "control remote"

    hide card drawobject "control local" of card "status panel lamp
    test" show card drawobject "control remote" of card "status panel
    lamp test"
  end mouseUp
  ************************************************************
  ************
  * *
  ** ID 27 --> card button "button id 27"
  * *
```

```
*************************************************************
************

on mouseUp
  if the visible of card drawobject "control local" then
    logverify "Control Local/Remote is set to remote."

    hide card drawobject "control local"
    show card drawobject "control remote"

    hide card drawobject "control local" of card "status panel lamp
    test" show card drawobject "control remote" of card "status
    panel lamp test"
  else
    logverify "Control Local/Remote is set to local."

    hide card drawobject "control remote"
    show card drawobject "control local"

    hide card drawobject "control remote" of card "status panel lamp
    test" show card drawobject "control local" of card "status panel
    lamp test"
  end if
end mouseUp
*************************************************************
************
* *
** ID 28 --> card button "button id 28"
* *
*************************************************************
************

on mouseUp
  logverify "Local Operation Launch Enable is off."

  hide card drawobject "launch enable enable"
  show card drawobject "launch enable off"

  hide card drawobject "launch enable enable" of card "status panel
  lamp test" show card drawobject "launch enable off" of card
  "status panel lamp test"
end mouseUp
*************************************************************
************
* *
** ID 29 --> card button "button id 29"
```

- 29 -

```
* *
*****************************************************************
************

on mouseUp
        logverify "Local Operation Launch Enable is enabled."

  hide card drawobject "launch enable off"
  show card drawobject "launch enable enable"

  hide card drawobject "launch enable off" of card "status panel lamp
  test" show card drawobject "launch enable enable" of card "status
  panel lamp test"
end mouseUp
*****************************************************************
************
* *
** ID 30 --> card button "button id 30"
* *
*****************************************************************
************

on mouseUp
  if the visible of card drawobject "launch enable off" then
    logverify "Local Operation Launch Enable is enabled."

    hide card drawobject "launch enable off"
    show card drawobject "launch enable enable"

    hide card drawobject "launch enable off" of card "status panel
    lamp test" show card drawobject "launch enable enable" of card
    "status panel lamp test"
  else
    logverify "Local Operation Launch Enable is off."

    hide card drawobject "launch enable enable"
    show card drawobject "launch enable off"

    hide card drawobject "launch enable enable" of card "status panel
    lamp test" show card drawobject "launch enable off" of card
    "status panel lamp test"
  end if
end mouseUp
*****************************************************************
************
* *
```

- 30 -

```
** ID 31 --> card button "button id 31"
* *
*************************************************************
************

on mouseUp
  logverify "Magazine power is off."

  hide card drawobject "magazine pwr on"
  hide card paintobject "magazine pwr"
  show card drawobject "magazine pwr off"

  hide card drawobject "magazine pwr on" of card "status panel lamp
  test" show card drawobject "magazine pwr off" of card "status
  panel lamp test"
end mouseUp
*************************************************************
************
* *
** ID 32 --> card button "button id 32"
* *
*************************************************************
************

on mouseUp
  logverify "Magazine power is on."

  hide card drawobject "magazine pwr off"
  show card drawobject "magazine pwr on"
  show card paintobject "magazine pwr"

  hide card drawobject "magazine pwr off" of card "status panel
  lamp test" show card drawobject "magazine pwr on" of card "status
  panel lamp test"
end mouseUp
*************************************************************
************
* *
** ID 33 --> card button "button id 33"
* *
*************************************************************
************

on mouseUp
  if the visible of card drawobject "magazine pwr off" then logverify
    "Magazine power is on."
```

```
        hide card drawobject "magazine pwr off"
      show card drawobject "magazine pwr on"
      show card paintobject "magazine pwr"

      hide card drawobject "magazine pwr off" of card "status panel
      lamp test" show card drawobject "magazine pwr on" of card
      "status panel lamp test"
    else
      logverify "Magazine power is off."

      hide card drawobject "magazine pwr on"
      hide card paintobject "magazine pwr"
      show card drawobject "magazine pwr off"

      hide card drawobject "magazine pwr on" of card "status panel
      lamp test" show card drawobject "magazine pwr off" of card
      "status panel lamp test"
    end if
  end mouseUp
  ***********************************************************
  ************
  * *
  ** ID 34 --> card button "button id 34"
  * *
  ***********************************************************
  ************

  on mouseUp
    logverify "Anti-Icing Power is off."

    hide card drawobject "anti icing on"
    show card drawobject "anti icing off"

    hide card drawobject "anti icing on" of card "status panel lamp
    test" show card drawobject "anti icing off" of card "status panel
    lamp test"
  end mouseUp
  ***********************************************************
  ************
  * *
  ** ID 36 --> card button "button id 36"
  * *
  ***********************************************************
  ************

  on mouseUp
```

```
    logverify "Anti-Icing Power is on."

    hide card drawobject "anti icing off"
    show card drawobject "anti icing on"

    hide card drawobject "anti icing off" of card "status panel lamp
    test" show card drawobject "anti icing on" of card "status panel
    lamp test"
end mouseUp
*************************************************************
************
* *
** ID 37 --> card button "button id 37"
* *
*************************************************************
************

on mouseUp
    if the visible of card drawobject "anti icing off" then
      logverify "Anti-Icing Power is on."

      hide card drawobject "anti icing off" show card drawobject "anti
      icing on"

      hide card drawobject "anti icing off" of card "status panel lamp
      test" show card drawobject "anti icing on" of card "status panel
      lamp test"
    else
      logverify "Anti-Icing Power is off."

      hide card drawobject "anti icing on"
      show card drawobject "anti icing off"

      hide card drawobject "anti icing on" of card "status panel lamp
      test" show card drawobject "anti icing off" of card "status panel
      lamp test"
    end if
end mouseUp
*************************************************************
************
* *
** ID 38 --> card button "button id 38"
* *
*************************************************************
************
```

- 33 -

```
on mouseUp
  logverify "Strikedown power is off."

  hide card drawobject "strikedown on"
  show card drawobject "strikedown off"

  hide card drawobject "strikedown on" of card "status panel lamp
  test" show card drawobject "strikedown off" of card "status panel
  lamp test"
end mouseUp
*************************************************************
************
* *
** ID 39 --> card button "button id 39"
* *
*************************************************************
************

on mouseUp
  logverify "Strikedown power is on."

  hide card drawobject "strikedown off"
  show card drawobject "strikedown on"

  hide card drawobject "strikedown off" of card "status panel lamp
  test" show card drawobject "strikedown on" of card "status panel
  lamp test"
end mouseUp
*************************************************************
************
* *
** ID 40 --> card button "button id 40"
* *
*************************************************************
************

on mouseUp
  if the visible of card drawobject "strikedown off" then
    logverify "Strikedown power is on."

    hide card drawobject "strikedown off"
    show card drawobject "strikedown on"

    hide card drawobject "strikedown off" of card "status panel lamp
    test" show card drawobject "strikedown on" of card "status
    panel lamp test"
```

```
  else
    logverify "Strikedown power is off."

    hide card drawobject "strikedown on"
    show card drawobject "strikedown off"

    hide card drawobject "strikedown on" of card "status panel lamp
    test" show card drawobject "strikedown off" of card "status
    panel lamp test"
  end if
end mouseUp
```

```
*****************************************************
************
* *
** ID 42 --> card button "Blown Fuse F1"
* *
*****************************************************
************

on mouseUp
  logverify "Status Panel Blown Fuse Indicator F1 Verified."
 answer "Status Panel Blown Fuse Indicator F1 verification has been
                        logged." with "OK"
end mouseUp
*****************************************************
************
* *
** ID 43 --> card button "Blown Fuse F2"
* *
*****************************************************
************

on mouseUp
  logverify "Status Panel Blown Fuse Indicator F2 Verified."
 answer "Status Panel Blown Fuse Indicator F2 verification has been
                        logged." with "OK"
end mouseUp
```

```
*****************************************************
************
* *
** ID 44 --> card button "Blown Fuse F3"
* *
*****************************************************
************

on mouseUp
  logverify "Status Panel Blown Fuse Indicator F3 Verified."
 answer "Status Panel Blown Fuse Indicator F3 verification has been
                        logged." with "OK"
end mouseUp
*****************************************************
************
* *
** ID 45 --> card button "Blown Fuse F4"
* *
*****************************************************
************

on mouseUp
  logverify "Status Panel Blown Fuse Indicator F4 Verified."
 answer "Status Panel Blown Fuse Indicator F4 verification has been
                        logged." with "OK"
end mouseUp
*****************************************************
************
* *
** ID 49 --> card button "High Temp"
* *
*****************************************************
************

on mouseUp
  logverify "Magazine Hazard High Temp Indicator Verified."
 answer "Magazine Hazard High Temp indicator  verification has been
                        logged." with "OK"
end mouseUp
*****************************************************
************
* *
** ID 50 --> card button "PS 2"
* *
```

```
*************************************************************
************

on mouseUp
  logverify "PS 2 Indicator Verified."
  answer "PS 2 indicator  verification has been logged." with "OK"
end mouseUp
*************************************************************
************
* *
** ID 51 --> card button "button id 51"
* *
*************************************************************
************

on mouseUp
  logverify "Status Panel Lamp Test Verified."

  go to card "status panel lamp test"
  go to card "status panel"
end mouseUp
*************************************************************
************
* *
** ID 52 --> card button "Low Temp"
* *
*************************************************************
************

on mouseUp
  logverify "Magazine Hazard Low Temp Indicator Verified."
 answer "Magazine Hazard Low Temp indicator  verification has been
                              logged." with "OK"
end mouseUp
*************************************************************
************
* *
** ID 53 --> card button "Sprinkler System Active"
* *
*************************************************************
************

on mouseUp
  logverify "Sprinkler System Active Indicator Verified."
  answer "Sprinkler System Active indicator  verification has been
                              logged." with "OK"
```

```
end mouseUp
*************************************************************
************
* *
** ID 54 --> card button "High Magazine Water"
* *
*************************************************************
************

on mouseUp
  logverify "High Magazine Water Indicator Verified."
answer "High Magazine Water indicator  verification has been logged."
                                  with "OK"
end mouseUp
*************************************************************
************
* *
** ID 55 --> card button "Low Deluge Water"
* *
*************************************************************
************

on mouseUp
  logverify "Low Deluge Water Indicator Verified."
 answer "Low Deluge Water indicator  verification has been logged."
                                  with "OK"
end mouseUp
*************************************************************
************
* *
** ID 56 --> card button "Low Deluge Pressure"
* *
*************************************************************
************

on mouseUp
  logverify "Low Deluge Pressure Indicator Verified."
answer "Low Deluge Pressure indicator  verification has been logged."
                                  with "OK"
end mouseUp
*************************************************************
************
* *
** ID 57 --> card button "Gas Hazard"
* *
```

```
*************************************************************
************

on mouseUp
  logverify "Gas Hazard Indicator Verified."
  answer "Gas Hazard indicator  verification has been logged." with
"OK"
end mouseUp
*************************************************************
************
* *
** ID 58 --> card button "LSEQ Cont Power Off"
* *
*************************************************************
************

on mouseUp
  logverify "LSEQ Cont Power Off Indicators Verified."
   answer "LSEQ Cont Power Off indicators  verification has been
                          logged." with "OK"
end mouseUp
*************************************************************
************
* *
** ID 59 --> card button "Missile Fuel Leak"
* *
*************************************************************
************

on mouseUp
  logverify "Missile Fuel Leak Indicators Verified."
 answer "Missile Fuel Leak indicators  verification has been logged."
                          with "OK"
end mouseUp
*************************************************************
************
* *
** ID 60 --> card button "Deluge System Active"
* *
*************************************************************
************

on mouseUp
  logverify "Deluge System Active Indicators Verified."
   answer "Deluge System Active indicators  verification has been
                          logged." with "OK"
```

```
end mouseUp
*****************************************************
************
* *
** ID 61 --> card button "High Plenum"
* *
*****************************************************
************

on mouseUp
  logverify "High Plenum Indicators Verified."
  answer "High Plenum indicators  verification has been logged."
with "OK"
end mouseUp
*****************************************************
************
* *
** ID 64 --> card button "Magazine PWR"
* *
*****************************************************
************

on mouseUp
  logverify "Magazine Power Indicator Verified."
  answer "Magazine Power indicator  verification has been logged."
                                  with "OK"
end mouseUp
*****************************************************
************
* *
** ID 71 --> card button "PS 1"
* *
*****************************************************
************

on mouseUp
  logverify "PS 1 Indicator Verified."
  answer "PS 1 indicator  verification has been logged." with "OK"
end mouseUp
*****************************************************
************
* *
** ID 1 --> card paintobject "Deluge Normal"
* *
```

- 40 -

```
*************************************************************
************

on mouseUp
  hide card paintobject "Deluge Normal"
  show card paintobject "Deluge Reset"

  hide card paintobject "Deluge Normal" of card "status panel lamp
  test" show card paintobject "Deluge Reset" of card "status panel
  lamp test"
end mouseUp
*************************************************************
************
* *
** ID 2 --> card paintobject "Anti Icing Bite Off"
* *
*************************************************************
************

on mouseUp
  hide card paintobject "Anti Icing Bite Off"
  show card paintobject "Anti Icing Bite Htr Off"

  hide card paintobject "Anti Icing Bite Off" of card "status panel
  lamp test" show card paintobject "Anti Icing Bite Htr Off" of card
  "status panel lamp test"
end mouseUp
*************************************************************
************
* *
** ID 3 --> card paintobject "Deluge Reset"
* *
*************************************************************
************

on mouseUp
  hide card paintobject "Deluge Reset"
  show card paintobject "Deluge Normal"

  hide card paintobject "Deluge Reset" of card "status panel lamp
  test" show card paintobject "Deluge Normal" of card "status panel
  lamp test"
end mouseUp
*************************************************************
************
* *
```

- 41 -

```
** ID 4 --> card paintobject "Anti Icing Bite Htr Off"
* *
*************************************************************
************

on mouseUp
  hide card paintobject "Anti Icing Bite Htr Off"
  show card paintobject "Anti Icing Bite Htr On"

  hide card paintobject "Anti Icing Bite Htr Off" of card "status panel
  lamp test" show card paintobject "Anti Icing Bite Htr On" of card
  "status panel lamp test"
end mouseUp
*************************************************************
************
* *
** ID 5 --> card paintobject "Anti Icing Bite Htr On"
* *
*************************************************************
************

on mouseUp
  hide card paintobject "Anti Icing Bite Htr On"
  show card paintobject "Anti Icing Bite Off"

  hide card paintobject "Anti Icing Bite Htr On" of card "status panel
  lamp test" show card paintobject "Anti Icing Bite Off" of card
  "status panel lamp test"
end mouseUp
*************************************************************
************
* *
** ID 1 --> bkgnd button "Launch Sequencer"
* *
*************************************************************
************

on mouseUp
  logverify "At launch sequencer."

  go to card "launch sequencer"
end mouseUp
*************************************************************
************
* *
** ID 2 --> bkgnd button "Status Panel"
```

```
* *
*************************************************************
************

on mouseUp
  logverify "At the status panel."
  go to card "status panel"
end mouseUp
*************************************************************
************    **
** ID 4 --> bkgnd button "Control & Maintainence"
* *
*************************************************************
************

on mouseUp
  logverify "At the Control & Maintainence panel."
  go to card "Control & Maintainence"
end mouseUp
*************************************************************
************    **
** ID 5 --> bkgnd button "System Setup"
* *
*************************************************************
************

on mouseUp
  go to card "systemsetup"
end mouseUp
*************************************************************
************    **
** ID 6 --> bkgnd button "Repairs"
* *
*************************************************************
************

on mouseUp
  go to card repair
end mouseUp
*************************************************************
************    **
** ID 7 --> bkgnd button "Verify Log"
* *
*************************************************************
************
```

```
on mouseUp
  go to card "Verify Log"
end mouseUp
*************************************************************
************    **
** ID 8 --> bkgnd button "Launch Control Unit"
* *
*************************************************************
************

on mouseUp
  logverify "At LCU"
  go to card LCU
end mouseUp
*************************************************************
************    **
** ID 6 --> card button "button id 6"
* *
*************************************************************
************

on mouseUp
  if the visible of card paintobject "On Line 0" then
    hide card paintobject "On Line 0"
    show card paintobject "Off Line 0"
  else
    hide card paintobject "Off Line 0"
    show card paintobject "On Line 0"
  end if
end mouseUp
*************************************************************
************    **
** ID 13 --> card button "button id 13"
* *
*************************************************************
************

on mouseUp
  if the visible of card paintobject "On Line 1" then
    hide card paintobject "On Line 1"
    show card paintobject "Off Line 1"
  else
    hide card paintobject "Off Line 1"
    show card paintobject "On Line 1"
  end if
```

```
end mouseUp
*****************************************************
************    **
** ID 14 --> card button "button id 14"
* *
*****************************************************
************

on mouseUp
  if the visible of card paintobject "On Line 2" then
    hide card paintobject "On Line 2"
    show card paintobject "Off Line 2"
  else
    hide card paintobject "Off Line 2"
    show card paintobject "On Line 2"
  end if
end mouseUp
*****************************************************
************    **
** ID 15 --> card button "button id 15"
* *
*****************************************************
************

on mouseUp
  if the visible of card paintobject "On Line 3" then
    hide card paintobject "On Line 3"
    show card paintobject "Off Line 3"
  else
    hide card paintobject "Off Line 3"
    show card paintobject "On Line 3"
  end if
end mouseUp
*****************************************************
************    **
** ID 18 --> card button "button id 18"
* *
*****************************************************
************

on mouseLeave
  hide card paintobject "Master Clear On"
            show card paintobject "Master Clear Off"
end mouseLeave

on mouseUp
```

```
  hide card paintobject "Master Clear On" show card paintobject
  "Master Clear Off"
end mouseUp

on mouseDown
  hide card paintobject "Master Clear Off" show card paintobject
  "Master Clear On"
end mouseDown

*************************************************************
************    **
** ID 22 --> card button "button id 22"
* *
*************************************************************
************

on mouseUp
  hide card paintobject "Alarm Off"
  hide card paintobject "Alarm Test"
  show card paintobject "Alarm Enable"
end mouseUp
*************************************************************
************    **
** ID 23 --> card button "button id 23"
* *
*************************************************************
************

on mouseUp
  hide card paintobject "Alarm Test" hide card paintobject "Alarm
  Enable" show card paintobject "Alarm Off"
end mouseUp
*************************************************************
************    **
** ID 24 --> card button "button id 24"
* *
*************************************************************
************

on mouseUp
  hide card paintobject "Alarm Enable"
  hide card paintobject "Alarm Off"
  show card paintobject "Alarm Test"
```

```
end mouseUp
*************************************************************
************    **
** ID 25 --> card button "button id 25"
* *
*************************************************************
************

on mouseUp
  if the visible of card paintobject "Alarm Enable" then
    hide card paintobject "Alarm Enable"
    show card paintobject "Alarm Off"
  else
    if the visible of card paintobject "Alarm Off" then hide card
      paintobject "Alarm Off"
      show card paintobject "Alarm Test" else
      hide card paintobject "Alarm Test" show card paintobject
      "Alarm Enable"
    end if
  end if
end mouseUp
*************************************************************
************    **
** ID 29 --> card button "button id 29"
* *
*************************************************************
************

on mouseUp
  if the visible of card paintobject "Power On" then
    hide card paintobject "Power Indicator"
    hide card paintobject "Power On"
    show card paintobject "Power Off"
  else
    hide card paintobject "Power Off"
    show card paintobject "Power Indicator"
    show card paintobject "Power On"
  end if
end mouseUp
*************************************************************
************    **
** ID 35 --> card button "button id 35"
* *
*************************************************************
************
```

```
on mouseUp
  hide card paintobject MPX
  hide card paintobject "CMPTR 2"
  hide card paintobject "CMPTR 2 Indicator"
  show card paintobject "CMPTR 1"
  show card paintobject "CMPTR 1 Indicator"
end mouseUp
*************************************************************
************    **
** ID 36 --> card button "button id 36"
* *
*************************************************************
************

on mouseUp
  hide card paintobject "CMPTR 2"
  hide card paintobject "CMPTR 2 Indicator"
  hide card paintobject "CMPTR 1"
  hide card paintobject "CMPTR 1 Indicator"
  show card paintobject MPX
end mouseUp
*************************************************************
************    **
** ID 37 --> card button "button id 37"
* *
*************************************************************
************

on mouseUp
  hide card paintobject "CMPTR 1"
  hide card paintobject "CMPTR 1 Indicator"
  hide card paintobject MPX
  show card paintobject "CMPTR 2"
  show card paintobject "CMPTR 2 Indicator"
end mouseUp
*************************************************************
************    **
** ID 38 --> card button "button id 38"
* *
*************************************************************
************

on mouseUp
  if the visible of card paintobject "CMPTR 1" then
    hide card paintobject "CMPTR 1"
```

```
      hide card paintobject "CMPTR 1 Indicator"
      show card paintobject MPX
    else
      if the visible of card paintobject MPX then
        hide card paintobject MPX
        show card paintobject "CMPTR 2"
        show card paintobject "CMPTR 2 Indicator"
      else
        hide card paintobject "CMPTR 2"
        hide card paintobject "CMPTR 2 Indicator"
        show card paintobject "CMPTR 1"
        show card paintobject "CMPTR 1 Indicator"
      end if
    end if
end mouseUp
*****************************************************************
************    **
** ID 42 --> card button "button id 42"
* *
*****************************************************************
************

on mouseUp
  if the visible of card paintobject "Battle Short On" then
    hide card paintobject "Battle Short On"
    hide card paintobject "Battle Short Indicator"
    show card paintobject "Battle Short Off"
  else
    hide card paintobject "Battle Short Off"
              show card paintobject "Battle Short On"
    show card paintobject "Battle Short Indicator" end if
end mouseUp
*****************************************************************
************    **
** ID 43 --> card button "Drive 0 Button"
* *
*****************************************************************
************

on mouseUp
  logverify "Tape Drive 0 Verified."
    answer "Tape Drive 0 verification has been logged." with "OK"
end mouseUp
*****************************************************************
************    **
```

```
** ID 44 --> card button "Drive 1 Button"
* *
*************************************************************
************

on mouseUp
  logverify "Tape Drive 1 Verified."
    answer "Tape Drive 1 verification has been logged." with "OK"
end mouseUp
*************************************************************
************    **
** ID 45 --> card button "Drive 2 Button"
* *
*************************************************************
************

on mouseUp
  logverify "Tape Drive 2 Verified."
    answer "Tape Drive 2 verification has been logged." with "OK"
end mouseUp
*************************************************************
************    **
** ID 46 --> card button "Drive 3 Button"
* *
*************************************************************
************

on mouseUp
  logverify "Tape Drive 3 Verified."
    answer "Tape Drive 3 verification has been logged." with "OK"
end mouseUp
*************************************************************
************    **
** ID 47 --> card button "Warnings"
* *
*************************************************************
************

on mouseUp
  push this card
  go to card warnings
end mouseUp
*************************************************************
************    **
** ID 1 --> bkgnd button "Launch Sequencer"
```

```
* *
*****************************************************
************

on mouseUp
  logverify "At launch sequencer."

  go to card "launch sequencer"
end mouseUp
*****************************************************
************    **
** ID 2 --> bkgnd button "Status Panel"
* *
*****************************************************
************

on mouseUp
  logverify "At the status panel."
  go to card "status panel"
end mouseUp
*****************************************************
************    **
** ID 3 --> bkgnd button "Recorder-Reproducer"
* *
*****************************************************
************

on mouseUp
  logverify "At the Recorder-Reproducer."
  go to card "Recorder Reproducer"
end mouseUp
*****************************************************
************    **
** ID 4 --> bkgnd button "System Setup"
* *
*****************************************************
************

on mouseUp
  go to card "systemsetup"
end mouseUp
*****************************************************
************    **
** ID 5 --> bkgnd button "Repairs"
```

```
* *
*************************************************************
************

on mouseUp
  go to card repair
end mouseUp
*************************************************************
************    **
** ID 6 --> bkgnd button "Verify Log"
* *
*************************************************************
************

on mouseUp
  go to card "Verify Log"
end mouseUp
*************************************************************
************    **
** ID 7 --> bkgnd button "Launch Control Unit"
* *
*************************************************************
************

on mouseUp
  logverify "At LCU"
  go to card LCU
end mouseUp
*************************************************************
************    **
** ID 8 --> card button "button id 8"
* *
*************************************************************
************

on mouseLeave
  hide card paintobject "Auto Start"
  show card paintobject "Auto Start-MA CLR"
end mouseLeave

on mouseUp
  hide card paintobject "Auto Start"
  show card paintobject "Auto Start-MA CLR"
end mouseUp

on mouseDown
```

```
    hide card paintobject "Auto Start-MA CLR"
    show card paintobject "Auto Start"
    logverify "On maintainence and control panel, Auto Start-MA CLR
                    switch toggled to Auto Start."
end mouseDown
*****************************************************************
************
* *
** ID 11 --> card button "button id 11"
* *
*****************************************************************
************

on mouseUp
  if the visible of card paintobject "Time Out ENBL" then
    hide card paintobject "Time Out ENBL"
    show card paintobject "Time Out DSBL" else
    hide card paintobject "Time Out DSBL" show card paintobject
    "Time Out ENBL"
  end if
end mouseUp
*****************************************************************
************    **
** ID 14 --> card button "button id 14"
* *
*****************************************************************
************

on mouseUp
  if the visible of card paintobject "Bootstrap 1" then
    hide card paintobject "Bootstrap 1"
    show card paintobject "Bootstrap 2"
  else
    hide card paintobject "Bootstrap 2"
    show card paintobject "Bootstrap 1"
  end if
end mouseUp
*****************************************************************
************    **
** ID 19 --> card button "button id 19"
* *
*****************************************************************
************

on mouseUp
```

```
    if the visible of card paintobject "Stops 1" then
      hide card paintobject "Stops 1"
      show card paintobject "Stops 1 Off"
    else
      hide card paintobject "Stops 1 Off"
      show card paintobject "Stops 1"
    end if
  end mouseUp
  ************************************************************
  ************    **
  ** ID 20 --> card button "button id 20"
  * *
  ************************************************************
  ************

  on mouseUp
    if the visible of card paintobject "Stops 2" then
      hide card paintobject "Stops 2"
      show card paintobject "Stops 2 Off"
    else
      hide card paintobject "Stops 2 Off"
      show card paintobject "Stops 2"
    end if
  end mouseUp
  ************************************************************
  ************    **
  ** ID 23 --> card button "button id 23"
  * *
  ************************************************************
  ************

  on mouseUp
    if the visible of card paintobject "Logic On" then
      hide card paintobject "Logic On"
      hide card paintobject "Logic Indicator"
      show card paintobject "Logic Off"
    else
      hide card paintobject "Logic Off"
      show card paintobject "Logic Indicator"
      show card paintobject "Logic On"
    end if
  end mouseUp
  ************************************************************
  ************    **
  ** ID 26 --> card button "button id 26"
```

```
* *
*************************************************************
************

on mouseUp
  if the visible of card paintobject "Battle Short On" then
    hide card paintobject "Battle Short On"
    hide card paintobject "Battle Short Indicator"
    show card paintobject "Battle Short Off"
  else
    hide card paintobject "Battle Short Off"
    show card paintobject "Battle Short Indicator"
    show card paintobject "Battle Short On"
  end if
end mouseUp
*************************************************************
***********    **
** ID 31 --> card button "button id 31"
* *
*************************************************************
************

on mouseUp
  hide card paintobject "RTC EXT"
  hide card paintobject "RTC 1 KHZ"
  hide card paintobject "RTC 32 KHZ"
  show card paintobject "RTC OFF"
end mouseUp
*************************************************************
***********    **
** ID 32 --> card button "button id 32"
* *
*************************************************************
************

on mouseUp
  hide card paintobject "RTC 1 KHZ"
  hide card paintobject "RTC 32 KHZ"
  hide card paintobject "RTC OFF"
  show card paintobject "RTC EXT"
end mouseUp
*************************************************************
***********    **
** ID 33 --> card button "button id 33"
```

```
* *
*************************************************************
************

on mouseUp
  hide card paintobject "RTC 32 KHZ" hide card paintobject "RTC OFF"
  hide card paintobject "RTC EXT"
  show card paintobject "RTC 1 KHZ" end mouseUp
*************************************************************
************    **
** ID 34 --> card button "button id 34"
* *
*************************************************************
************

on mouseUp
  hide card paintobject "RTC OFF"
  hide card paintobject "RTC EXT"
  hide card paintobject "RTC 1 KHZ"
  show card paintobject "RTC 32 KHZ"
end mouseUp
*************************************************************
***********    **
** ID 39 --> card button "button id 39"
* *
*************************************************************
************

on mouseUp
  hide card paintobject "Alarm Test"
  hide card paintobject "Alarm ENBL"
  show card paintobject "Alarm DSBL"
end mouseUp
*************************************************************
***********    **
** ID 40 --> card button "button id 40"
* *
*************************************************************
************

on mouseUp
  hide card paintobject "Alarm DSBL"
  hide card paintobject "Alarm Test"
  show card paintobject "Alarm ENBL"
```

```
end mouseUp
*************************************************************
************    **
** ID 41 --> card button "button id 41"
* *
*************************************************************
************

on mouseUp
  hide card paintobject "Alarm ENBL"
  hide card paintobject "Alarm DSBL"
  show card paintobject "Alarm Test"
end mouseUp
*************************************************************
************    **
** ID 45 --> card button "button id 45"
* *
*************************************************************
************

on mouseUp
  hide card paintobject "Fault On Line"
  hide card paintobject "Fault Off"
  show card paintobject "Fault Off Line"
end mouseUp
*************************************************************
************    **
** ID 46 --> card button "button id 46"
* *
*************************************************************
************

on mouseUp
  hide card paintobject "Fault Off Line"
  hide card paintobject "Fault On Line"
  show card paintobject "Fault Off"
end mouseUp
*************************************************************
************    **
** ID 48 --> card button "button id 48"
* *
*************************************************************
************

on mouseUp
  hide card paintobject "Fault Off"
```

```
    hide card paintobject "Fault Off Line"
    show card paintobject "Fault On Line"
  end mouseUp
  ************************************************************
  ************    **
  ** ID 49 --> card button "button id 49"
  * *
  ************************************************************
  ************

  on mouseUp
    if the visible of card paintobject "Fault On Line" then
      hide card paintobject "Fault On Line"
      show card paintobject "Fault Off"
    else
      if the visible of card paintobject "Fault Off" then hide card
        paintobject "Fault Off"
              show card paintobject "Fault Off Line"
      else
        hide card paintobject "Fault Off Line"
        show card paintobject "Fault On Line"
      end if
    end if
  end mouseUp
  ************************************************************
  ************    **
  ** ID 50 --> card button "button id 50"
  * *
  ************************************************************
  ************

  on mouseUp
    if the visible of card paintobject "Alarm Test" then
      hide card paintobject "Alarm Test"
      show card paintobject "Alarm ENBL"
    else
      if the visible of card paintobject "Alarm ENBL" then hide card
        paintobject "Alarm ENBL"
        show card paintobject "Alarm DSBL" else
        hide card paintobject "Alarm DSBL" show card paintobject
        "Alarm Test"
      end if
    end if
  end mouseUp
```

```
*************************************************************
************    **
** ID 54 --> card button "button id 54"
* *
*************************************************************
************

on mouseLeave
  hide card paintobject "MA CLR"
  show card paintobject "Auto Start-MA CLR"
end mouseLeave

on mouseUp
  hide card paintobject "MA CLR"
  show card paintobject "Auto Start-MA CLR"
end mouseUp

on mouseDown
  hide card paintobject "Auto Start-MA CLR"
  show card paintobject "MA CLR"
  logverify "On maintainence and control panel, Auto Start-MA CLR
switch toggled to MA CLR."
end mouseDown
*************************************************************
************
* *
** ID 56 --> card button "button id 56"
* *
*************************************************************
************

on mouseLeave
  hide card paintobject "Load"
  show card paintobject "Load-Stop"
end mouseLeave

on mouseUp
  hide card paintobject "Load"
  show card paintobject "Load-Stop"
end mouseUp

on mouseDown
  hide card paintobject "Load-Stop"
  show card paintobject "Load"
  logverify "On maintainence and control panel, LOAD/STOP switch
toggled to LOAD."
```

```
  put "" into card field display of card lcu
put "C0   00:02:58      0581V PATCH LVL: PP BLD DATE: 12 JUN 1991"
              into line 1 of card field display of card lcu
 put "C0   00:02:58  SHIP/SITE: SS VERSION V RATE: L DATE: 12 JUN
          1991" into line 2 of card field display of card lcu
  put "                    CLOCK:  cccc HZ  CONFIG: fff" into line 3 of
card field display of card lcu
  put "                    ADAPTATION FILE :SS1LBMCTX" into line 4 of
                card field display of card lcu
  put "C0   00:02:58  SYSTEM INITIALIZATIONN COMPLETE" into line
  5 of card field display of card lcu put "C0    00:02:58   LCU 0000
  I/C CHNL 0010 UP" into line 6 of card field display of card lcu
 put "C0    00:02:58   LCU 0000 I/C CHNL 0012 UP" into line 7 of card
                field display of card lcu
end mouseDown
*************************************************************
************
* *
** ID 57 --> card button "button id 57"
* *
*************************************************************
************

on mouseLeave
  hide card paintobject "Stop"
  show card paintobject "Load-Stop"
end mouseLeave

on mouseUp
  hide card paintobject "Stop"
  show card paintobject "Load-Stop"
end mouseUp

on mouseDown
  hide card paintobject "Load-Stop"
  show card paintobject "Stop"
  logverify "On maintainence and control panel, LOAD/STOP switch
toggled to STOP."
end mouseDown
*************************************************************
************
* *
** ID 58 --> card button "Warnings"
```

```
* *
*************************************************************
************

on mouseUp
  push this card
  go to card warnings
end mouseUp
*************************************************************
************    **
** ID 27 --> card paintobject "RTC Off"
* *
*************************************************************
************

on mouseUp
  hide card paintobject "RTC Off"
  show card paintobject "RTC EXT"
end mouseUp
*************************************************************
************    **
** ID 28 --> card paintobject "RTC EXT"
* *
*************************************************************
************

on mouseUp
  hide card paintobject "RTC EXT"
  show card paintobject "RTC 1 KHZ"
end mouseUp
*************************************************************
************    **
** ID 29 --> card paintobject "RTC 1 KHZ"
* *
*************************************************************
************

on mouseUp
  hide card paintobject "RTC 1 KHZ"
  show card paintobject "RTC 32 KHZ"
end mouseUp
*************************************************************
************    **
** ID 30 --> card paintobject "RTC 32 KHZ"
```

```
* *
*****************************************************
************

on mouseUp
  hide card paintobject "RTC 32 KHZ"
  show card paintobject "RTC Off"
end mouseUp
*****************************************************
***********    **
** ID 2 --> bkgnd button "Verify Log"
* *
*****************************************************
************

on mouseUp
  go to card "Verify Log"
end mouseUp
*****************************************************
***********    **
** ID 3 --> bkgnd button "System Setup"
* *
*****************************************************
************

on mouseUp
  go to card "systemsetup"
end mouseUp
*****************************************************
************
* *
** ID 5 --> bkgnd button "Launch Sequencer"
* *
*****************************************************
************

on mouseUp
  logverify "At launch sequencer."

  go to card "launch sequencer"
end mouseUp
*****************************************************
***********    **
** ID 6 --> bkgnd button "Status Panel"
```

```
* *
*************************************************************
************

on mouseUp
  logverify "At the status panel."
  go to card "status panel"
end mouseUp
*************************************************************
************    **
** ID 7 --> bkgnd button "Recorder-Reproducer"
* *
*************************************************************
************

on mouseUp
  logverify "At the Recorder-Reproducer."
  go to card "Recorder Reproducer"
end mouseUp
*************************************************************
************    **
** ID 8 --> bkgnd button "Control & Maintainence"
* *
*************************************************************
************

on mouseUp
  logverify "At the Control & Maintainence panel."
  go to card "Control & Maintainence"
end mouseUp
*************************************************************
************    **
** ID 10 --> bkgnd button "Repairs"
* *
*************************************************************
************

on mouseUp
  go to card repair
end mouseUp
*************************************************************
************    **
** ID 11 --> bkgnd button "Launch Control Unit"
* *
*************************************************************
************
```

```
on mouseUp
  logverify "At LCU"
  go to card LCU
end mouseUp
*************************************************************
************    **
** ID 12 --> bkgnd button "Warnings"
* *
*************************************************************
************

on mouseUp
  push this card
  go to card warnings
end mouseUp
*************************************************************
************    **
** ID 7 --> card button "Reset Log"
* *
*************************************************************
************

on mouseUp
  global logcount
  put 1 into logcount
  put "" into card field log of card "Verify Log"
end mouseUp
*************************************************************
************    **
** ID 3 --> card button "Toggle Faults"
* *
*************************************************************
************

on mouseUp
    if the hilite of card button normal of card systemsetup then
    set the hilite of card button normal to false
    set the hilite of card button faults to true

    show card paintobject "current fault title"
    show card field "current fault"
  else
    set the hilite of card button faults of card systemsetup to false
    set the hilite of card button normal of card systemsetup to true

     hide card paintobject "current fault title" of card systemsetup
```

```
        hide card paintobject "faults title" of card systemsetup
          hide card field "current fault" of card systemsetup
          hide card field faults of card systemsetup
      end if
    end mouseUp
    ***********************************************************
    **************    **
    ** ID 8 --> card button "Toggle Faults"
    * *
    ***********************************************************
    ***************

    on mouseUp
      if the hilite of card button "Mod 0" then
          set the hilite of card button "Mod 0" to false
            set the hilite of card button "Mod 1" to true
  else
              if the hilite of card button "Mod 1" then
      set the hilite of card button "Mod 1" to false set the hilite of
      card button "Mod 2" to true
    else
      set the hilite of card button "Mod 2" to false set the hilite of
      card button "Mod 0" to true
    end if
  end if
end mouseUp
***********************************************************
***********    **
** ID 18 --> card field "current fault"
* *
***********************************************************
************

on mouseUp
  hide the card field "current fault"
  hide the card paintobject "current fault title"
  show the card paintobject "faults title"
  show the card field faults
end mouseUp
***********************************************************
***********    **
** ID 19 --> card field "Faults"
* *
***********************************************************
************
```

```
on mouseup
  put "card field faults" into thefield
  put clickline (thefield) into linenumber

  put line lineNumber of the value of thefield into theText
  if theText is not empty then
    put (number of chars of line 1 to lineNumber of the value of
    theField) + 1 into endChar do "select char (endChar -
    length(theText)) to endChar of" && theField
    put thetext into card field "current fault"
  end if
  hide the card field faults
  hide the card paintobject "faults title"
  show the card paintobject "current fault title"
  show the card field "current fault"
end mouseup
*****************************************************
************
* *
** ID 4 --> card field "LCUCommands"
* *
*****************************************************
************

on mouseup
  put "card field LCUCommands" into thefield
  put clickline (thefield) into linenumber

  put line lineNumber of the value of thefield into theText
  if theText is not empty then
    put (number of chars of line 1 to lineNumber of the value of
theField) + 1 into endChar
    do "select char (endChar - length(theText)) to endChar of" &&
theField
    put "" into card field display
    if thetext is bite then
      put "C0    00:02:58    CMD?=  BITE" into line 1 of card field
display
      ask "ENTER  S  OR M, N (S=SYSTEM; M=A,F  N=1-8) :" with "S"
      put "C0   00:03:01   ENTER  S  OR M, N (S=SYSTEM; M=A,F  N=1-
      8) :" & it into line 2 of card field display if the hilite of card
      button faults of card systemsetup then
        put "C0       00:03:50       CMD?=  BITE ERROR 0153" into line
3 of card field display
      else
```

```
        put "C0      00:03:50     CMD?= BITE REQUEST COMPLETE"
into line 3 of card field display
      end if
    else
      if thetext is not MINV then
        put "C0      00:11:08     CMD?=  " & thetext into line 1 of
card field display
        answer thetext & " is not currently implemented." with "OK"
      else
        put "C0      00:11:08     CMD?=  MINV" into line 1 of card
field display
        put "C0      00:11:15     ENTER M, N (M=A,F N=1-8,A) : F,A"
into line 2 of card field display
        put "C0      00:11:20     MAGAZINE F" into line 3 of card
field display
        put "C0      00:11:20     MODULE 1 (AVAL)" into line 4 of
card field display
        put "C0      CELL  TYPE  STAT REM W/HD  DLF" into line 5 of
card field display
        put "C0        1                    EMPT" into line 6 of card
field display
        put "C0        2                    EMPT" into line 7 of card
field display
        put "C0        3                    EMPT" into line 8 of card
field display
        put "C0        4                    EMPT" into line 9 of card
field display
        put "C0        5                    EMPT" into line 10 of card
field display
        put "C0        6                    EMPT" into line 11 of card
field display
        put "C0        7                    EMPT" into line 12 of card
field display
        put "C0        8                    EMPT" into line 13 of card
field display
        put "C0" into line 14 of card field display
        put "C0      00:11:21   MODULE 2 (AVAL)" into line 15 of
        card field display
        put "C0      CELL  TYPE  STAT REM W/HD  DLF" into line 16
        of card field display
        put "C0        1                    EMPT" into line 17 of card
        field display
        put "C0        2                    EMPT" into line 18 of card
        field display
```

```
put "C0        3                    EMPT" into line 19 of card
field display
put "C0        4                    EMPT" into line 20 of card
field display
put "C0        5                    EMPT" into line 21 of card
field display
put "C0        6                    EMPT" into line 22 of card
field display
put "C0        7                    EMPT" into line 23 of card
field display
put "C0        8                    EMPT" into line 24 of card
field display
put "C0" into line 25 of card field display
put "C0      00:11:22   MODULE 3 (AVAL)" into line 26 of
card field display
put "C0      CELL  TYPE  STAT REM W/HD  DLF" into line 27
of card field display
put "C0        1                    EMPT" into line 28 of card
field display
put "C0        2                    EMPT" into line 29 of card
field display
put "C0        3                    EMPT" into line 30 of card
field display
put "C0        4                    EMPT" into line 31 of card
field display
put "C0        5                    EMPT" into line 32 of card
field display
put "C0        6                    EMPT" into line 33 of card
field display
put "C0        7                    EMPT" into line 34 of card
field display
put "C0        8                    EMPT" into line 35 of card
field display
put "C0" into line 36 of card field display
put "C0      00:11:23   MODULE 4 (AVAL)" into line 37 of
card field display
put "C0      CELL  TYPE  STAT REM W/HD  DLF" into line 38
of card field display
put "C0        1                    EMPT" into line 39 of card
field display
put "C0        2                    EMPT" into line 40 of card
field display
put "C0        3                    EMPT" into line 41of card
field display
```

```
put "C0        4                    EMPT" into line 42 of card
field display
put "C0        5                    EMPT" into line 43 of card
field display
put "C0        6                    EMPT" into line 44 of card
field display
put "C0        7                    EMPT" into line 45 of card
field display
put "C0        8                    EMPT" into line 46 of card
field display
put "C0" into line 47 of card field display
put "C0      00:11:24   MODULE 5 (AVAL)" into line 48 of
card field display
put "C0      CELL  TYPE  STAT REM W/HD  DLF" into line 49
of card field display
put "C0        1                    EMPT" into line 50 of card
field display
put "C0        2                    EXPD" into line 51 of card
field display
put "C0        3                    EMPT" into line 52 of card
field display
put "C0        4                    EMPT" into line 53 of card
field display
put "C0        5                    EXPD" into line 54 of card
field display
put "C0        6    STRIKEDOWN" into line 55 of card field
display
put "C0        7    STRIKEDOWN" into line 56 of card field
display
put "C0        8    STRIKEDOWN" into line 57 of card field
display
put "C0" into line 58 of card field display
put "C0      00:11:25   MODULE 6 (AVAL)" into line 59 of
card field display
put "C0      CELL  TYPE  STAT REM W/HD  DLF" into line 60
of card field display
put "C0        1                    EMPT" into line 61 of card
field display
put "C0        2                    EXPD" into line 62 of card
field display
put "C0        3                    EMPT" into line 63 of card
field display
put "C0        4                    EMPT" into line 64 of card
field display
```

```
put "C0        5                    EMPT" into line 65 of card
field display
put "C0        6                    EMPT" into line 66 of card
field display
put "C0        7                    EXPD" into line 67 of card
field display
put "C0        8                    EMPT" into line 68 of card
field display
put "C0" into line 69 of card field display
put "C0      00:11:27   MODULE 7 (AVAL)" into line 70 of
card field display
put "C0      CELL  TYPE  STAT REM W/HD  DLF" into line 71
of card field display
put "C0        1                    EMPT" into line 72 of card
field display
put "C0        2                    EMPT" into line 73 of card
field display
put "C0        3                    EMPT" into line 74 of card
field display
put "C0        4                    EMPT" into line 75 of card
field display
put "C0        5                    EMPT" into line 76 of card
field display
put "C0        6                    EMPT" into line 77 of card
field display
put "C0        7                    EMPT" into line 78 of card
field display
put "C0        8                    EMPT" into line 79 of card
field display
put "C0" into line 80 of card field display
put "C0    00:11:28   MODULE 8 (AVAL)" into line 81 of card
field display put "C0   CELL  TYPE  STAT REM W/HD  DLF"
into line 82 of card field display put "C0   1      EMPT" into
line 83 of card field display
put "C0        2                    EXPD" into line 84 of card
field display
put "C0        3                    EMPT" into line 85 of card
field display
put "C0        4                    EMPT" into line 86 of card
field display
put "C0        5                    EMPT" into line 87 of card
field display
put "C0        6                    EXPD" into line 88 of card
field display
```

```
            put "C0        7                    EMPT" into line 89 of card
field  display
            put "C0        8                    EMPT" into line 90 of card
field  display
            put "C0" into line 91 of card field display
          end if
        end if
      end if
end mouseup
*****************************************************
************
* *
** ID 1 --> card button "Launch Sequencer"
* *
*****************************************************
************

on mouseUp
  go to card "launch sequencer repair 1"
end mouseUp
*****************************************************
************
* *
** ID 6 --> card button "button id 6"
* *
*****************************************************
************

on mouseUp
  answer "This repair item is yet to be implemented." with "OK"
end mouseUp
*****************************************************
************
* *
** ID 7 --> card button "button id 7"
* *
*****************************************************
************

on mouseUp
  answer "This repair item is yet to be implemented." with "OK"
end mouseUp
*****************************************************
************
* *
```

```
** ID 8 --> card button "button id 8"
* *
*************************************************************
************

on mouseUp
  answer "This repair item is yet to be implemented." with "OK"
end mouseUp
*************************************************************
************
* *
** ID 1 --> card button "button id 1"
* *
*************************************************************
************

on mouseUp
  go to card "launch sequencer repair 2"
end mouseUp
*************************************************************
************
* *
** ID 2 --> card button "button id 2"
* *
*************************************************************
************

on mouseUp
  go to card repair
end mouseUp
*************************************************************
************
* *
** ID 1 --> card button "button id 1"
* *
*************************************************************
************

on mouseUp
  go to card "launch sequencer repair 1"
end mouseUp
*************************************************************
************
* *
** ID 2 --> card button "button id 2"
```

```
* *
*************************************************************
************

on mouseUp
  go to card "launch sequencer repair 3"
end mouseUp
*************************************************************
************
* *
** ID 3 --> card button "button id 3"
* *
*************************************************************
************

on mouseUp
  go to card "launch sequencer repair 1"
end mouseUp
*************************************************************
************
* *
** ID 1 --> card button "button id 1"
* *
*************************************************************
************

on mouseUp
  go to previous card
end mouseUp
*************************************************************
************
* *
** ID 5 --> card button "Replace Card"
* *
*************************************************************
************

on mouseUp
  show card paintobject "LRUs Title"
  show card field "LRUs"
end mouseUp
*************************************************************
************
* *
** ID 8 --> card field "LRUs"
* *
```

```
*************************************************************
************

on mouseup
  put "card field LRUs" into thefield
  put clickline (thefield) into linenumber

  put line lineNumber of the value of thefield into theText
  if theText is not empty then
    put (number of chars of line 1 to lineNumber of the value of
    theField) + 1 into endChar do "select char (endChar -
    length(theText)) to endChar of" && theField
  end if
  if the hilite of card button faults of card systemsetup then
    if thetext is "A8" then
      send mouseup to card button "toggle faults" of card
    systemsetup end if
  end if
  hide card field LRUs
  hide card paintobject "LRUs Title"
  answer "Card " & thetext & " has been replaced." with "OK
end mouseup
*************************************************************
************    **
** ID 8360 --> background "Tools"
* *
*************************************************************
************

on showinfo
  show bg drw stackinfoborder
  show bg pnt stackinfotitle
  show bg fld stackinfo
  show bg btn file
  show bg btn stackinfodone
  show bg pnt stackinfodonetitle
end showinfo

on printName object
  global printCount
  put object
  put "ID" && (the last word of (the id of object)) && "-->" && (the
                        name of object) ¬
into line printCount of bg fld stackInfo of cd 1 of bg tools
  put printCount + 1 into printCount
end printName
```

```
on printscript object
  global outputfile
  put object
  put the script of object into theScript
  if theScript is not empty then
    write
*********************************************************
************* & return ¬
    to file outputfile
    write "*** & return to file outputfile
    write "** ID" && (the last word of (the id of object)) && "-->" &&
(the name of object) & return ¬ to file outputfile
    write "*** & return to file outputfile
                                write
*********************************************************
                ************* & return & return ¬
     to file outputfile
    write theScript to file outputfile
  end if
end printscript object
*********************************************************
************ **
** ID 3 --> bkgnd button "stackInfoDone"
* *
*********************************************************
************

on mouseUp
  hide bg drw stackinfoborder
  hide bg pnt stackinfotitle
  hide bg fld stackinfo
  hide bg btn file
  hide bg btn stackinfodone
  hide bg pnt stackinfodonetitle
end mouseUp
*********************************************************
************ **
** ID 6 --> bkgnd button "File"
* *
*********************************************************
************

on mouseUp
        ask "Export to what file?" with "The Universe:stuff"
  if it is empty then
```

```
      exit mouseUp
    else
      put it into filename
      open file filename
      write bg fld stackinfo to file filename
      close file filename
    end if
    put "Save Complete"
  end mouseUp
  ************************************************************
  ************    **
  ** ID 9 --> bkgnd button "getNames"
  * *
  ************************************************************
  *************

  on mouseUp
    global printCount
    put "" into bg fld stackInfo
    showinfo
    put 1 into printCount
    lock screen
    doStack printName, "bg tools"
    unlock screen
    put "Get Names and IDs Done"
  end mouseUp
  ************************************************************
  ************    **
  ** ID 13 --> bkgnd button "getScripts"
  * *
  ************************************************************
  *************

  on mouseUp
    global outputfile
    ask "Export to what file?" with "The Universe:stuff"
    if it is empty then
      exit mouseUp
    else
      put it into outputfile
      open file outputfile
      doStack printscript, "bg tools"
      close file outputfile
      put "Get Scripts Done"
    end if
```

```
end mouseUp
*************************************************************
************    **
** ID 15 --> bkgnd button "getScripts"
* *
*************************************************************
************

on mouseUp
  showinfo
end mouseUp
*************************************************************
************    **
** ID 5 --> bkgnd drawobject "stackinfoborder"
* *
*************************************************************
************


*************************************************************
************    **
** ID 1 --> card button "Done"
* *
*************************************************************
************

on mouseUp
  pop card
end mouseUp
*************************************************************
************
* *
** ID 2 --> card field "Warnings"
* *
*************************************************************
************

on mouseUp

  -- This is hardcoded for this demo.  Not really useful

  put "card field warnings" into thefield
  put clickline (thefield) into linenumber      -- relative line that was
                                   clicked
  if linenumber <= 5 then
     put 1 into linenumber
```

```
    else
      if linenumber >= 7 and linenumber <= 9 then
        put 3 into linenumber
      else
        if linenumber >= 11 and linenumber <= 12 then
          put 5 into linenumber
        else
          if linenumber >= 14 and linenumber <= 15 then
            put 7 into linenumber
          else
            if linenumber >= 17 and linenumber <= 20 then
              put 9 into linenumber
            else
              if linenumber >= 22 and linenumber <= 24 then
                put 11 into linenumber
              else
                put 2 into linenumber
              end if
            end if
          end if
        end if
      end if
    end if
    put line lineNumber of the value of thefield into theText
    if theText is not empty then
      logverify  (thetext)
      put (number of chars of line 1 to lineNumber of the value of
      theField) + 1 into endChar do "select char (endChar -
      length(theText)) to endChar of" && theField
    end if
  end mouseUp
```

ML:smb

What is claimed is:

1. A method for providing simulation, training and evaluation for a system, comprising the steps of:

providing a simulation mode which provides at least one screen with at least one switch and one indicator;

recording when a switch is selected;

recording when the indicator is selected; and providing a log mode which displays the data indicating when a switch was selected and when an indicator was selected.

2. A method, as claimed in claim 1, wherein the simulation mode also provides a warning button, further comprising the steps of:

providing a warning mode which displays a list of warnings on the screen;

recording which warning is selected from the list of warnings on the screen; and providing the recorded warnings to the log mode.

3. A method for providing simulation, training and evaluation for a system, comprising the steps of:

providing a simulation mode which provides at least one screen with at least one switch and one indicator, wherein the simulation mode also provides a warning button;

recording when a switch is selected;

recording when the indicator is selected;

providing a log mode which displays the data indicating when a switch was selected and when an indicator was selected;

providing a warning mode which displays a list of warnings;

recording which warning is selected from the list of warnings;

providing the recorded warnings to the log mode;

providing a fault mode that simulates the breakdown of the system;

recording the faults simulated in the fault mode;

providing a repair mode to select repairs;

recording the repairs selected; and providing the recorded repairs to the log mode.

* * * * *